US007201374B2

(12) United States Patent
Bielman

(10) Patent No.: US 7,201,374 B2
(45) Date of Patent: Apr. 10, 2007

(54) METHOD AND ARTICLE OF MANUFACTURE FOR COLLECTIBLE GAME

(75) Inventor: Tyler Bielman, Seattle, WA (US)

(73) Assignee: Wizards of the Coast, Inc., Renton, WA (US)

( * ) Notice: Subject to any disclaimer, the term of this patent is extended or adjusted under 35 U.S.C. 154(b) by 0 days.

(21) Appl. No.: 10/689,971

(22) Filed: Oct. 20, 2003

(65) Prior Publication Data

US 2004/0084842 A1 May 6, 2004

Related U.S. Application Data

(60) Provisional application No. 60/495,507, filed on Aug. 15, 2003, provisional application No. 60/420,894, filed on Oct. 23, 2002.

(51) Int. Cl.
*A63F 3/00* (2006.01)

(52) U.S. Cl. ..... 273/289; 273/255; 273/262

(58) Field of Classification Search ..... 273/276, 273/289, 292, 293, 255, 262; 446/69
See application file for complete search history.

(56) References Cited

U.S. PATENT DOCUMENTS

| | | | | |
|---|---|---|---|---|
| 2,945,696 | A * | 7/1960 | Johanningmeier | 273/147 |
| 3,738,659 | A * | 6/1973 | Partridge | 273/246 |
| 4,906,216 | A * | 3/1990 | Abeshouse | 446/256 |
| 4,950,912 | A * | 8/1990 | Goldfarb et al. | 273/249 |
| 5,067,723 | A * | 11/1991 | Yurkovic | 273/249 |
| 5,580,294 | A * | 12/1996 | Briant | 446/110 |
| 5,766,077 | A * | 6/1998 | Hongo | 463/30 |
| 6,659,463 | B2 * | 12/2003 | Mackey | 273/276 |
| 6,857,633 | B1 * | 2/2005 | Mackey | 273/156 |
| 6,938,898 | B2 * | 9/2005 | Merritt, III | 273/236 |
| 6,994,344 | B2 * | 2/2006 | Kitaygorodskiy et al. | 273/255 |
| 2003/0020239 | A1 * | 1/2003 | Hagen et al. | 273/296 |
| 2003/0071414 | A1 | 4/2003 | Weisman | |
| 2004/0212148 | A1 * | 10/2004 | Losey et al. | 273/138.1 |
| 2004/0227292 | A1 * | 11/2004 | Bodish | 273/289 |

OTHER PUBLICATIONS

Z-Cardz The game (3 pages).*
What are Z-cardz (1 page).*
Verssen, D., "Z Cardz the Game™ Rule Book" (28 pages) and playing pieces (4 cards), 2001, 2002.
"Pops Punch & Build Punch Out Play System™," Taiwan, 1 sheet including copy of card AE05.
Z cardz, 3 sheets, http://www.toysnjoys.com/megazcards.html, accessed Jun. 24, 2003, 3 pages.
Recursive Media, LLC, "Shop by Brand—zCardz," 2002, http://www.youngbuilder.com/brand/index.cfm?category_id=16&category_name=zCardz&s, accessed Jun. 24, 2003, 1 page.

(Continued)

*Primary Examiner*—Vishu Mendiratta
(74) *Attorney, Agent, or Firm*—Perkins Coie LLP

(57) ABSTRACT

A game, toy or article of manufacture includes a set of rules and at least one model. The model has multiple movable parts, where under the rules of play, the model begins in an assembled configuration. As the model loses points under the rules of play, at least some of the parts are removed from the model, or replaced with substitute parts. The model may be formed from a panel or other substantially planar member, with the individual pieces formed therein. Methods of game play, computer-implemented games, and other aspects of the invention are described herein. Many other options are possible, as described above.

15 Claims, 24 Drawing Sheets

OTHER PUBLICATIONS

WizKids LLC, "Shadowrun Duels Expanded Rules," 2002, 2003, http://www.wizkidsgames.com/sadowrun/sr_article.asp?cid=37678, accessed Jul. 17, 2003, 7 pages.

Wizkids LLC, "Shadowrun™ Duels," 2002, http://www.wizkidsgmes.com/shadowrun/sr_article.asp?cid=37678, accessed Jul. 17, 2003, 2 pages.

"Beyblade VForce™ Official Strategy Guide," 5 pages.

WizKids LLC, "Mage Knight Complete Rules of Play," 2003, 15 pages.

ToyWiz.com, "Stikfas Omega Male Armoured Knight with Stallion Build Your Own Action Figure Kit," http://www.toywiz.com/stikalmalwit.html and http://store4.yimg.com/I/dragonballzcentral_1775_614330922 and 614364964, accessed Jan. 28, 2004, 3 pages.

The Triangle, "Stickfas wars entertain," 2004, http://entertainment.thetriangle.org/2002/09/19/stickfas.html, accessed Jan. 28, 2004, 2 pages.

ICv2 News, "Z-G Game Combines Action Figures with CCG Anime-based Action Game," May 10, 2001, http://www.icv2.com/articles/news/381.html, accessed Jan. 28, 2004, 2 pages.

Hasbro, "Xevoz™ Battle Terrain™ Game Rules," 2003, Pawtucket, RI, 10 pages.

Hasbro, "Xevoz™ Data File," 2003, Pawtucket, RI, 2 pages.

Automoton, Inc., "Let's Play Z-G™ Basic Rules," 2001, 1 oversized page.

* cited by examiner

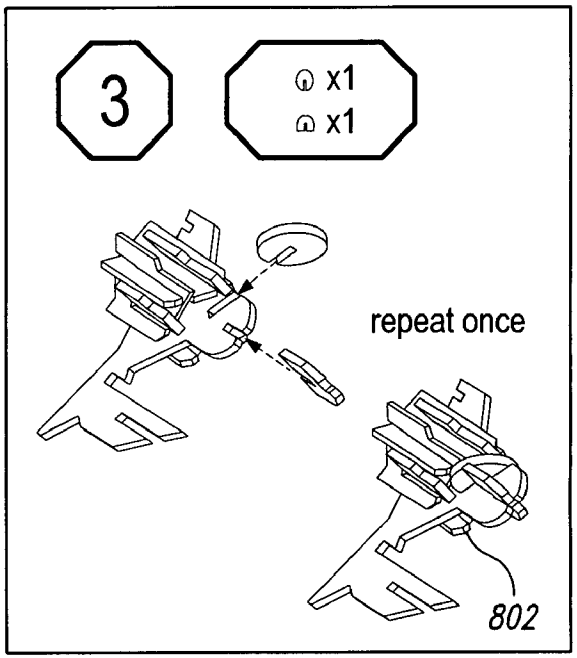
Fig. 8A
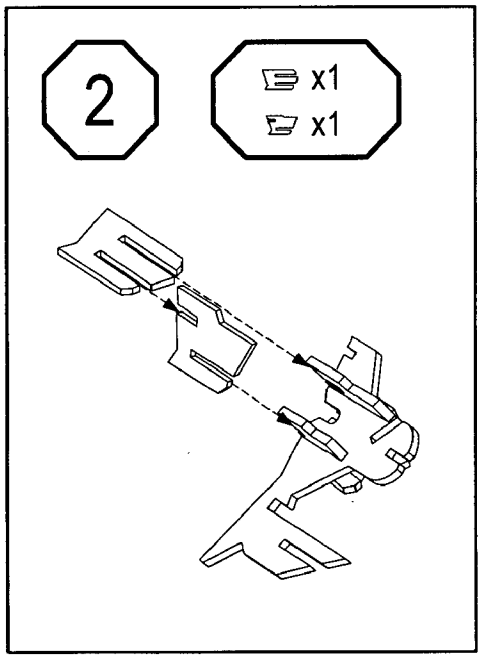
Fig. 8B
Fig. 8C

ROLLERS

Within any particular silhouette (card) there are several different skins applied to create visual and mechanical variations.

For example, a shotgun-type weapon and its particular roller may be "painted" in a style to make it look like it belongs to the *Speed Brats* faction and its roller may yield a hit 60% of the time, while on the next row down the same shotgun and roller may be "painted" in a *Junkyard Dog* motif and the roller may only yield a hit result 45% of the time.

Every roller has a particular number of faces. Each face may yield a different result or combination of results.

The different rypes of results are:

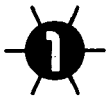

Damage
you inflict X damage to a target of your opponent's choosing.

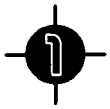

Bullseye
You inflict X damage to a target of your choosing.

Backfire
You take X damage.

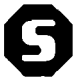

Stun
your opponent is stunned for the remainder of the round.

---

The following two icons indicate additional affects and appear in addition to one or more of the above icons:

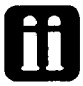

Full-Auto
Immediately fire again with the same weapon.

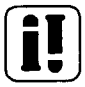

Quick Shot
Immediately fire again with a different weapon.

*Fig. 16*

METHOD AND ARTICLE OF MANUFACTURE FOR COLLECTIBLE GAME

CROSS-REFERENCE TO RELATED APPLICATION(S)

This application claims the benefit of commonly assigned U.S. Provisional Patent Application Nos. 60/420,894, filed Oct. 23, 2002, and 60/495,507, filed Aug. 15, 2003.

BACKGROUND

Collectible trading card games are known. U.S. Pat. No. 5,622,332 describes such card games. Further, collectible miniatures games are known, such as U.S. Patent Application No. 20030071414.

The miniatures described in the above game, as well as other miniatures games such as WARHAMMER™ by Games Workshop, provide completed or substantially completed toys that may be employed in a game. Relatively complex rules associated with the game allow players to battle to each other using the miniatures and in accordance with the rules.

Z-CARDS and POPS™ provide thin plastic cards with pre-punched model pieces that may be removed and assembled into a toy. The toy may then apparently be used in a game. However, the game does not incorporate the toys into it. Instead, the toys are simply superficial to the game and used as markers; any other object may be used in the game instead of the toy.

BRIEF DESCRIPTION OF THE DRAWINGS

FIGS. 8A through 8G are isometric views showing the sequential steps in assembling a variety of generally two-dimensional pieces into another vehicle.

FIG. 16 is a table of symbols and associated game play affects with respect to the randomizers of FIGS. 14A–15B.

Figure 1A:
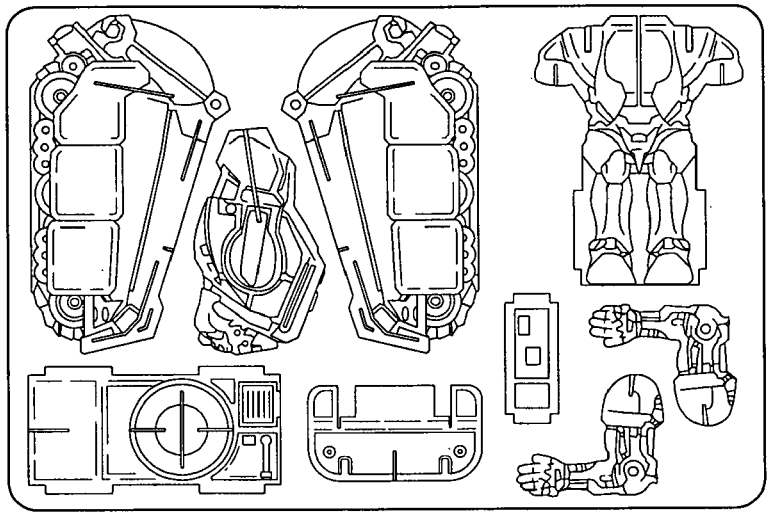
FIG. 1A is a top plan view of an embodiment of the invention as a generally two-dimensional card having punch-out pieces for allowing a user to assemble the pieces into a robot.

In the drawings, the same reference numbers and acronyms identify elements or acts with the same or similar functionality for ease of understanding and convenience. Various depicted elements are not necessarily drawn to scale, and these various elements may be arbitrarily enlarged to improve legibility.

The headings provided herein are for convenience only and do not necessarily affect the scope or meaning of the claimed invention.

A portion of this disclosure contains material to which a claim for copyright is made. The copyright owner has no objection to the facsimile reproduction by anyone of the patent document or patent disclosure (including Figures), as it appears in the Patent and Trademark Office patent file or records, but reserves all other copyright rights whatsoever.

DETAILED DESCRIPTION

Aspects of the invention are directed to a game, toy or article of manufacture that includes a set of rules and a model. The model has multiple movable parts, where under the rules of play, the model begins in an assembled configuration. As the model loses points under the rules of play, at least some of the parts are removed from the model, or replaced with substitute parts. The model may be formed from a panel or other substantially planar member, with the individual pieces formed therein. Methods of game play, computer-implemented games, and other aspects of the invention are described herein.

An embodiment of the game, described below, includes a model-building toy having cutouts formed within a heavy cardstock, sheet plastic, or other substantially rigid planar material. The pieces may be readily punched out or removed from the card and assembled by hand, such as with slotted parts fitting together to form a model. The model may then have interchangeable components that increase its complexity, so that the toy may be modular with its model, components and associated pieces. In one embodiment, for example, a robot or vehicle model may have interchangeable gun or weapon components that may be fitted to the robot or vehicle.

The game associated with the toy provides additional layers of complexity. In the depicted embodiment described below, a gun is associated with a particular randomizer, random value generator, or "roller." Two robots, vehicles or other models may then fight against one another, where each gun and associated randomizer determines whether a hit is scored against an opposing model. If a hit is scored, parts are removed from the model. Many other alternatives are possible, as described below. The game may be referred to as a "customizable model game."

The invention will now be described with respect to various embodiments. The following description provides specific details for a thorough understanding of, and enabling description for, these embodiments of the invention. However, one skilled in the art will understand that the invention may be practiced without these details. In other instances, well-known structures and functions are not shown or described in detail to avoid unnecessarily obscuring the description of the embodiments of the invention.

Suitable Model-Building Toy

Figure 1B:
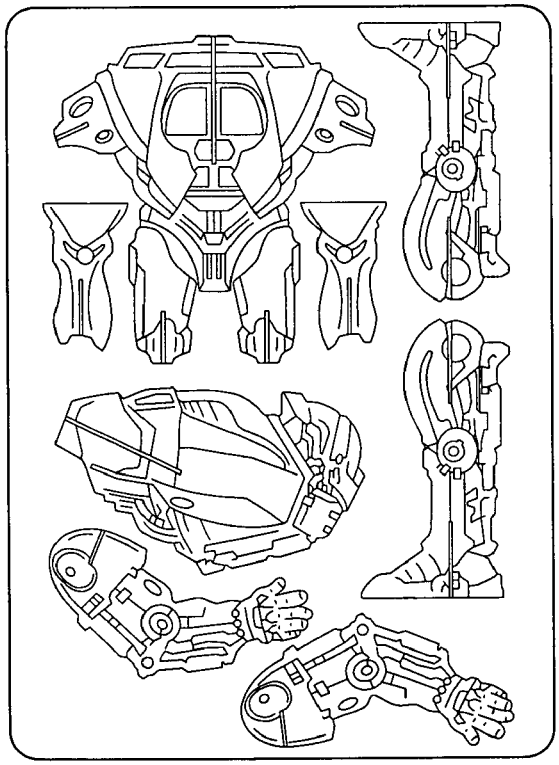
FIG. 1B is a top plan view of an alternate embodiment to that of FIG. 1A.

Under the depicted embodiment, a user or player assembles a chassis or model to create the main piece onto which the player attaches accessories or components, such as the two robots shown in FIGS. 1A and 1B, respectively. While the depicted embodiment shows robots, any chassis or model may form the base on which components (described below) may be added. The pieces may be readily hand-built without tools, adhesives or other supplies. For example, the pieces may be configured to be snap-fit together, to fit in a slot—within-groove fashion, or to be assembled using other known techniques.

The model may be formed within a piece of heavy cardstock, sheet plastic, or other substantially rigid planar material. In one example, sheet plastic having a thickness of approximately 1 millimeter is printed on both sides with model components, although other thicknesses and materials may be used. The components are scored or partially cut out from the plastic sheet so that the user may readily punch the pieces out from the remaining "waste material" of the card. The dimensions of the model determine the size of the card needed, but in two examples the card may be 6×4 centimeters or 5×7 inches, although other sizes are of course possible. In the depicted embodiment, no tools or glue are needed to build the model, and the model can be assembled entirely by hand.

Figure 2:
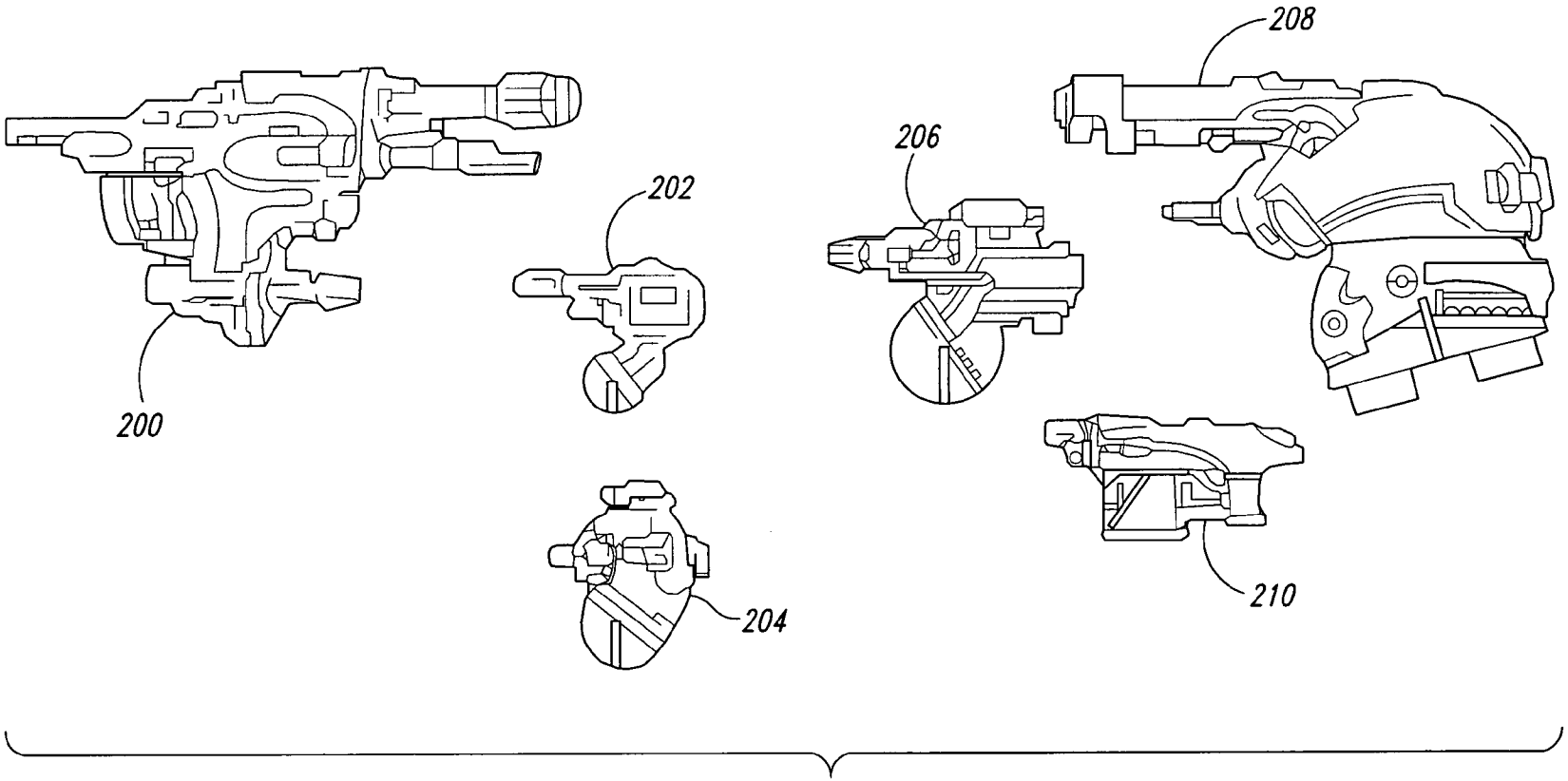
FIG. 2 is a top plan view of examples of six different guns that may be added to one of the robots of FIG. 1A or 1B.
Figure 3:
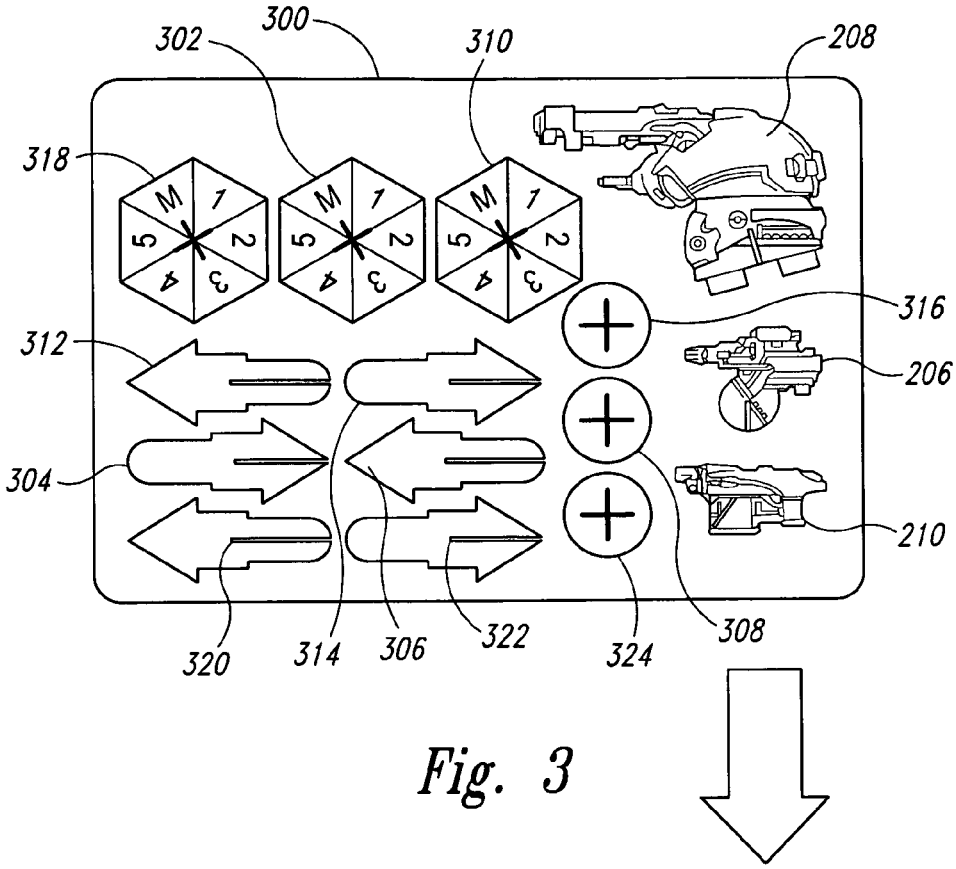
FIG. 3 is a top plan view of an example of a two-dimensional card having punch-out pieces for three rollers and three associated guns.
Figure 4A:
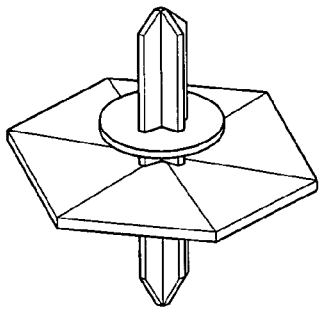
FIG. 4A is an isometric view of an example of an assembled roller.
Figure 4B:
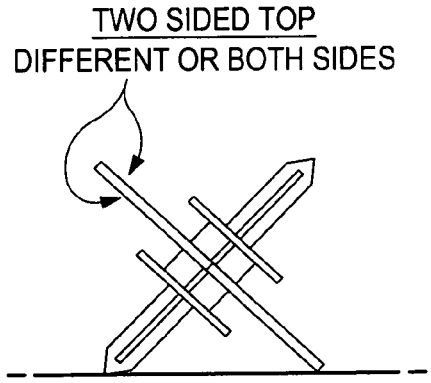
FIG. 4B is a side elevational view of the roller of FIG. 4A.

Components may then be added to the basic model, such as weapons 200–210 shown in FIG. 2. As a result, users may customize their robots. Each gun has associated with it a randomizer or "roller," such as those shown in FIGS. 3–6B. (The terms "roller" and "randomizer" are generally used interchangeably herein, and may randomly generate numbers, values, symbols or other indicia under the game rules.) As shown in FIG. 3, a card 300 includes guns 206, 208 and 210, with associated rollers assembled from pieces 302, 304, 306 and 308; 310, 312, 314 and 316; and 318, 320, 322 and 324, respectively. The rollers and guns may be color-coordinated to readily determine which gun is associated with which roller. Of course, other methods of matching a randomizer with a game component may be employed, such as texture, shape, size, symbols/letters, etc. FIGS. 4A and 4B show an example of an assembled roller.

Figure 5A:
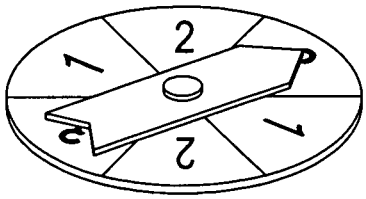
FIG. 5A is an isometric view of a spinner.
Figure 5B:
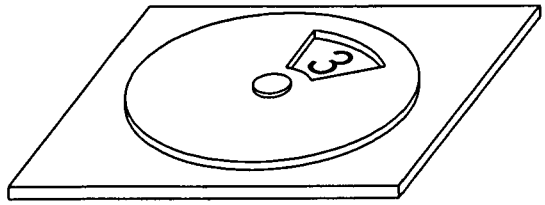
FIG. 5B is an isometric view of an alternative embodiment to the spinner of FIG. 5A.
Figure 5C:
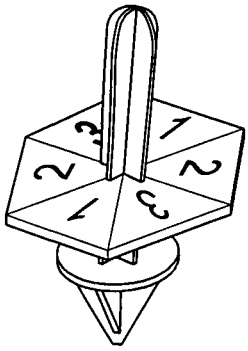
FIG. 5C is an isometric view showing an alternative embodiment to the spinner of FIG. 4A.
Figure 5D:
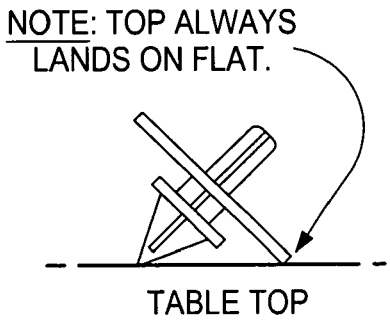
FIG. 5D is a side elevational view of the spinner of FIG. 5C.
Figure 5E:
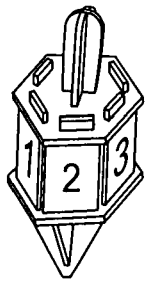
FIG. 5E is an isometric view of another embodiment of a spinner.
Figure 5F:
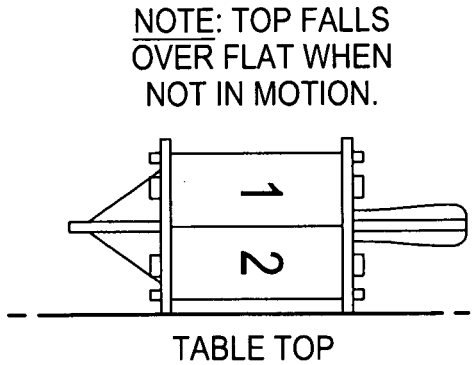
FIG. 5F is a side elevational view of the spinner of FIG. 5E.
Figure 5G:
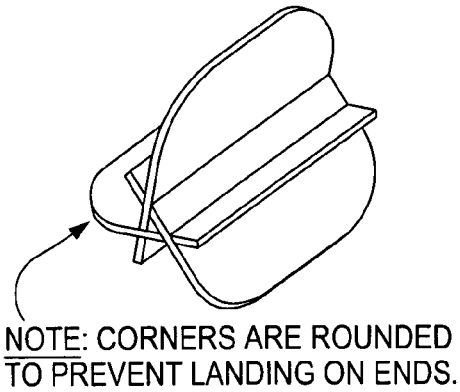
FIG. 5G is an isometric view showing an example of a three-sided die.
Figure 5H:
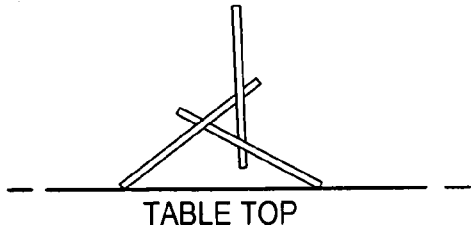
FIG. 5H is a side elevational view of the die of FIG. 5G.

Many other randomizers are, of course, possible. For example, FIGS. 5A and 5B show examples of simple spinners that may be assembled from cardstock or similar base components. FIGS. 5C and 5D show an example of a simple top or spinner, whereas FIGS. 5E and 5F show an example of a more complex spinner. FIGS. 5G and 5H show an example of a three-sided die. Complex spinners may, of course, be created, such as the rotating drum spinner shown in FIG. 51. Indeed, complex randomizer models may form an independent aspect of the invention. Various other randomizers may be possible, such as catapult devices, other multisided dies, etc. In general, in the depicted embodiment, all randomizers are assembled in a similar way as the models, from punch-out components formed in cardstock or sheet plastic.

Figure 6B:
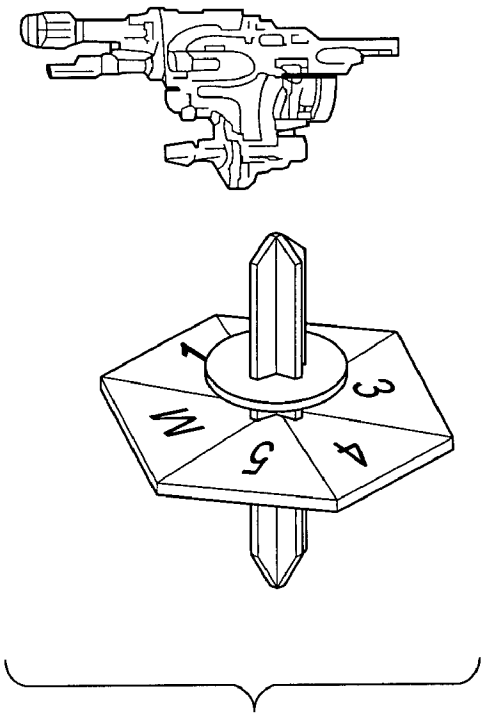
FIG. 6B is a top plan view of the gun of FIG. 6A and an isometric view of its associated spinner.
Figure 6A:
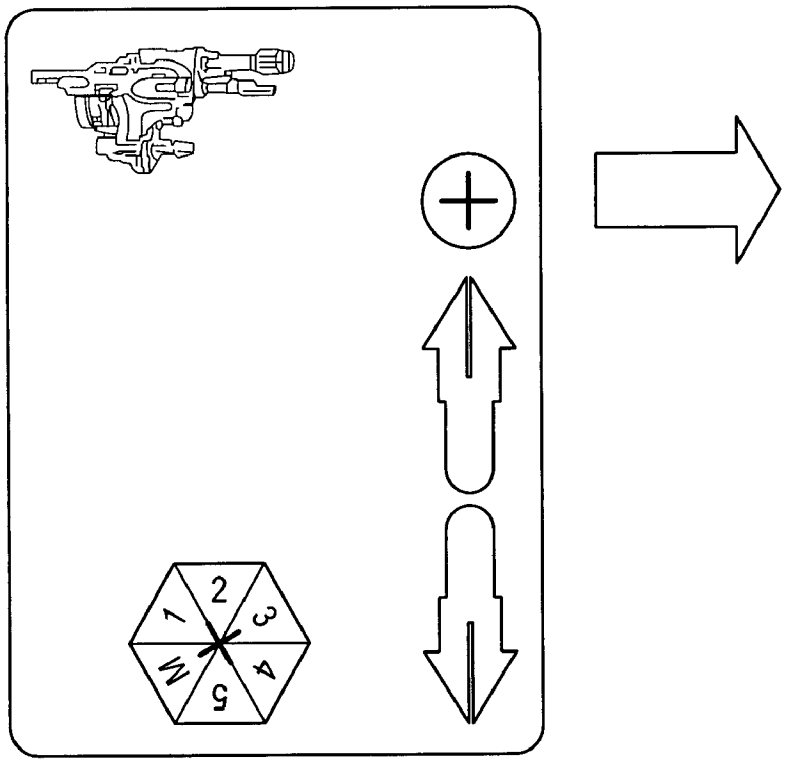
FIG. 6A is a top plan view of an example of a card having a single gun and its associated spinner.
Figure 7A:
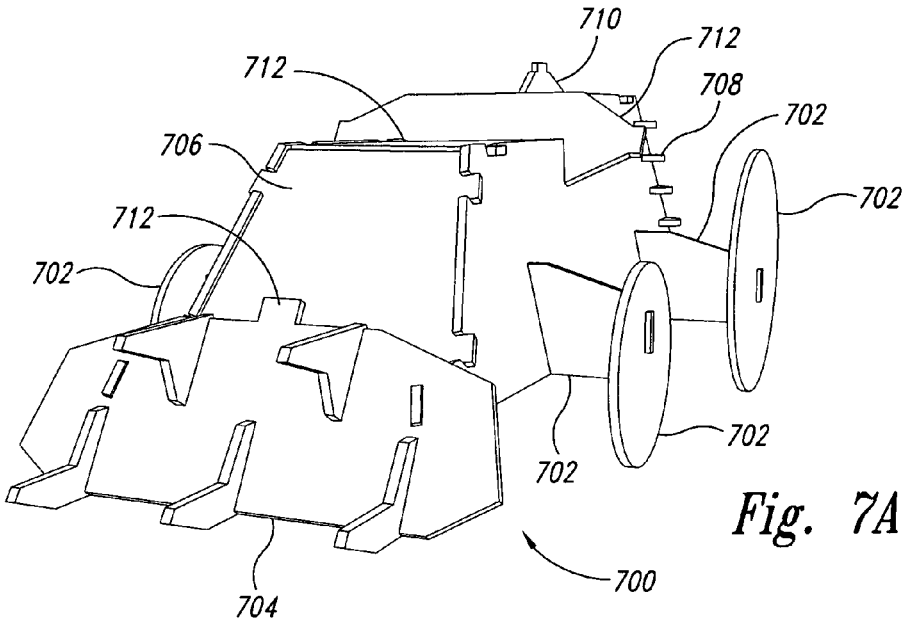
FIG. 7A is an isometric view of a vehicle assembled from an assortment of generally two-dimensional pieces.
Figure 7B:
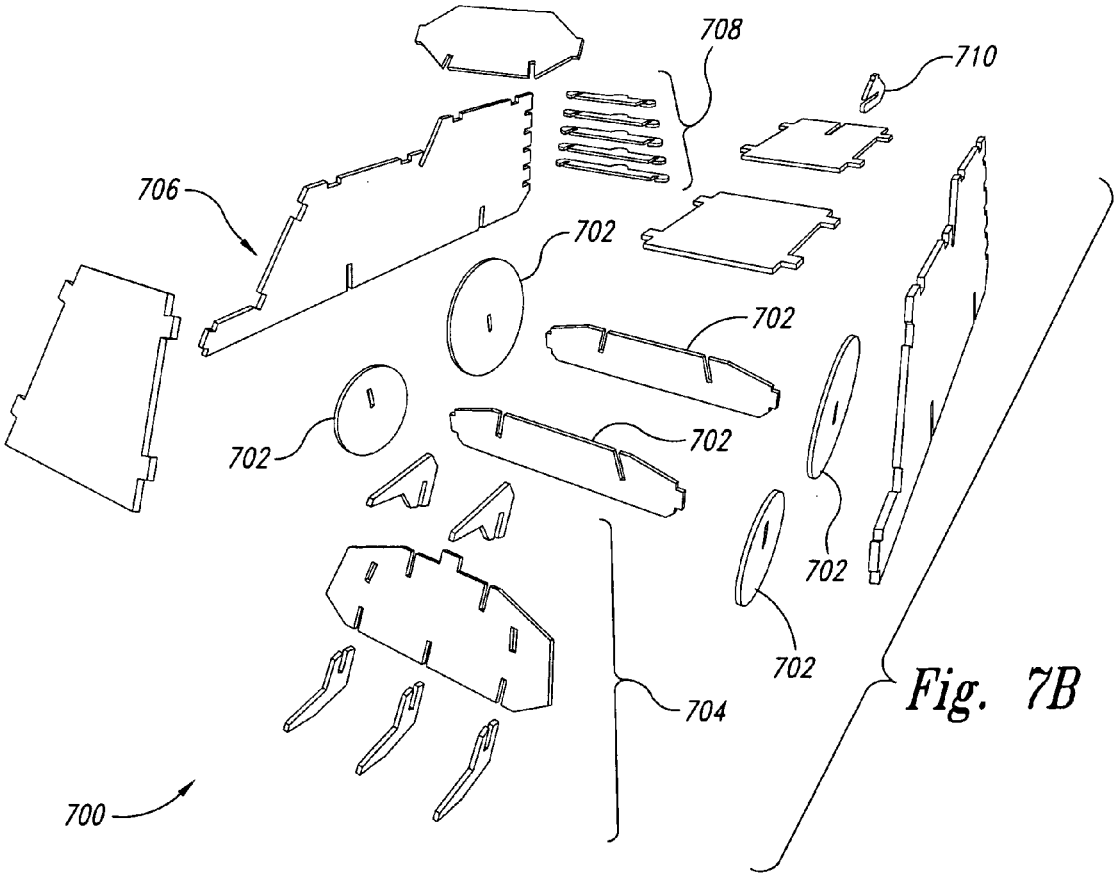
FIG. 7B is an exploded view of the vehicle of FIG. 7A.
Figure 7C:
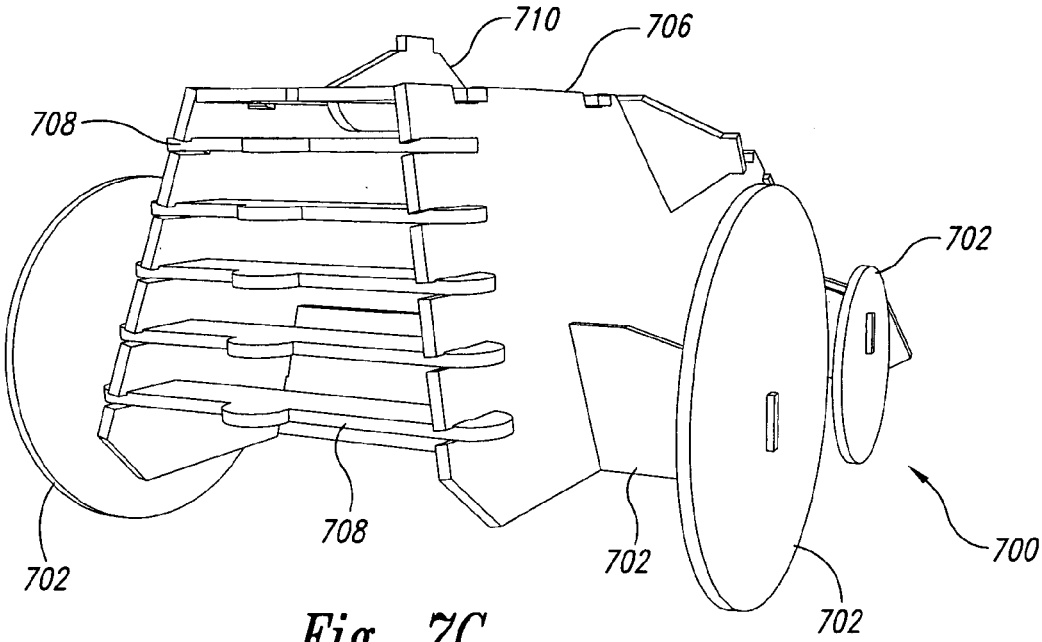
FIG. 7C is a rear isometric view of the vehicle of FIG. 7A.
Figure 7D:
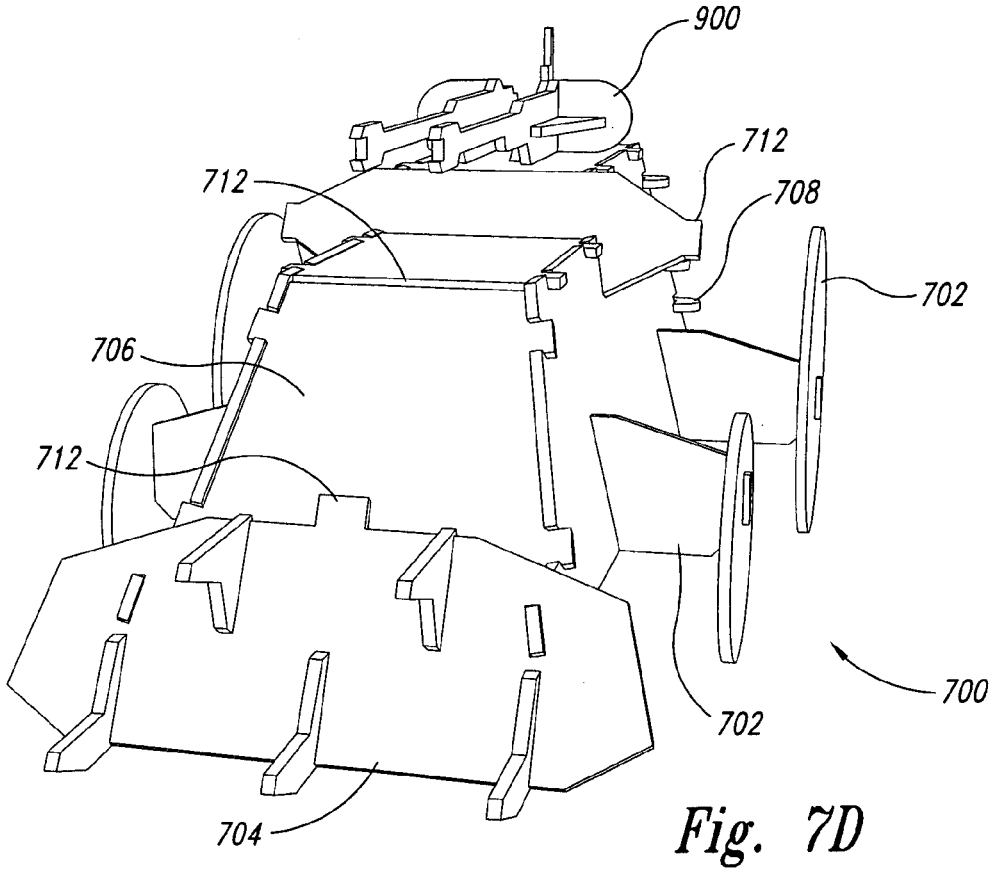
FIG. 7D is an isometric view of the vehicle of FIG. 7A, shown with a gun.

FIG. 6A shows another example of a gun and associated randomizer formed on a piece of sheet plastic, with FIG. 6B showing an enlargement of the gun and assembled spinner of FIG. 6A. As described in more detail below, each weapon may have a corresponding randomizer, whereby the rarer the weapon, the more exotic or complex the roller, and possibly the more powerful the weapon in a particular game. (The term "game" may refer to both the game mechanic that includes rules of play that define how players may play a game with their assembled toys (e.g., robots) and the combined toy and associated game mechanic.)

An additional example of models, accessories and randomizers are shown in FIGS. 7A through 13B. As shown in FIGS. 7A through 7D, a vehicle 700 includes wheels and axles 702 and a front-mounted scoop 704 mounted to a body 706. As shown more clearly in FIGS. 7E and 7C, armor 708 is represented as 5 elongated tabs inserted into a rear of the vehicle 700. FIG. 7D shows an example of a gun 900 mounted to a gun mount 710. Other gun mounts 712 may be provided on the vehicle 700.

Figure 8E:
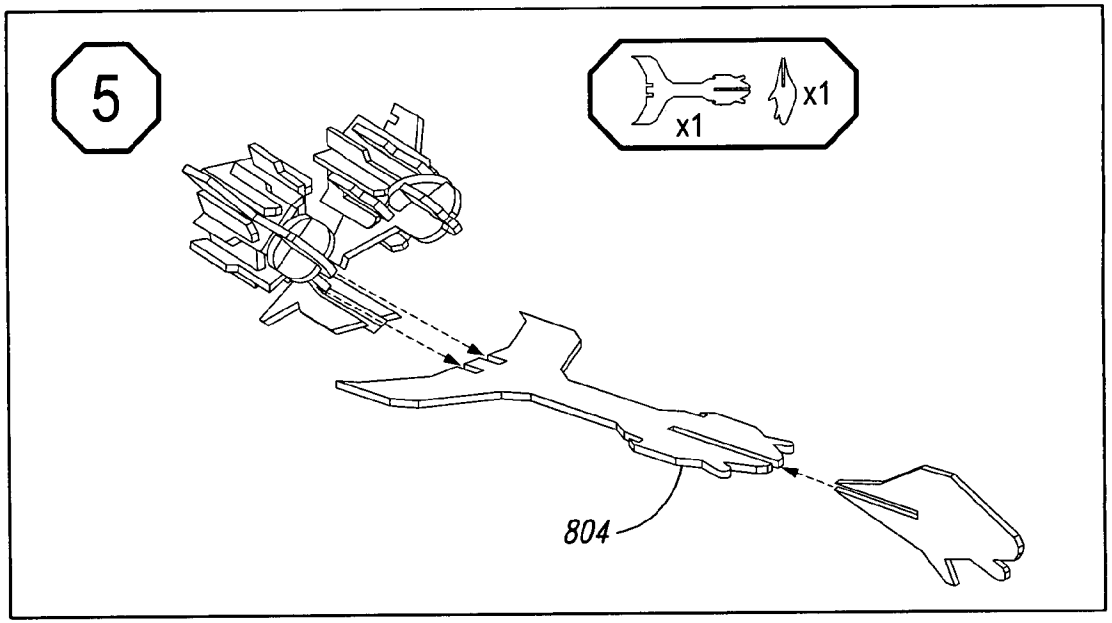
Figure 8D:
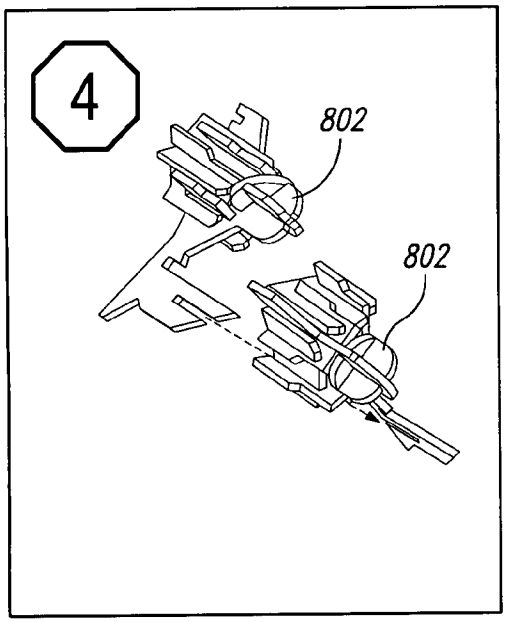
Figure 8G:
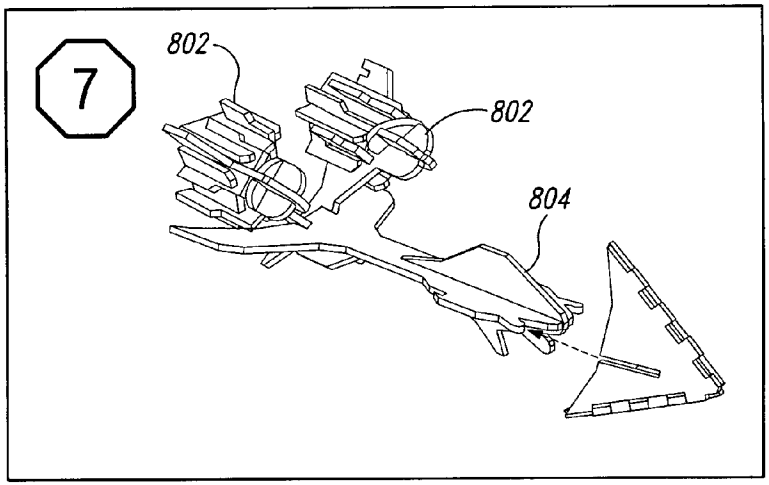
Figure 8F:
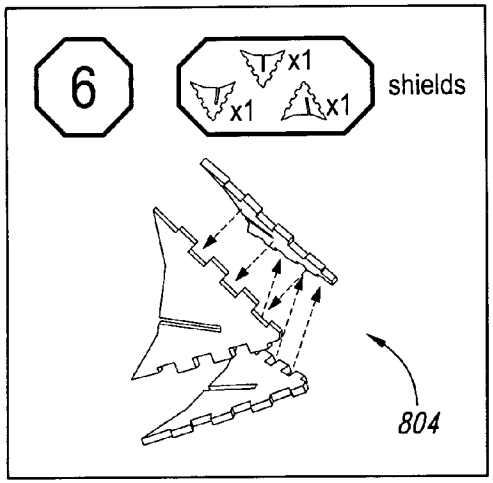
Figure 8H:
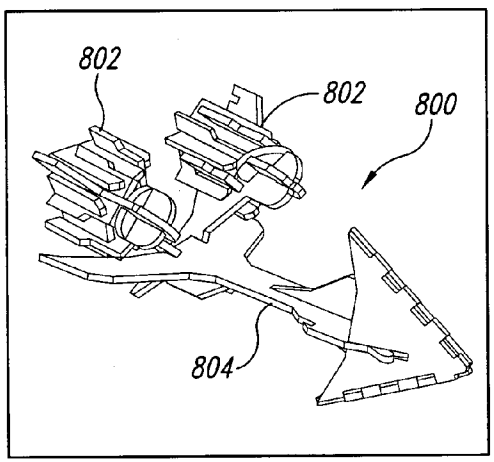
FIG. 8H is an isometric view of the vehicle assembled under the steps illustrated in FIGS. 8A through 8G.

Many other vehicles are possible, such as a half-track vehicle, a tank vehicle, a "spider-like" vehicle with articulated limbs, and so forth. For example, FIGS. 7A through 7H show steps involved in assembling a flying vehicle 800 formed of a pair of engines 802 and a body 804. FIGS. 8A through 8C show how 9 pieces are assembled to form one of the engines 802, with the process repeated again for a second engine. FIG. 8D shows how the two engines 802 are coupled together, while FIGS. 8E through 8G show how the engines are fixed to the body 804, and the body is assembled. The final, assembled vehicle 800 is shown in FIG. 8H.

Figure 9A:
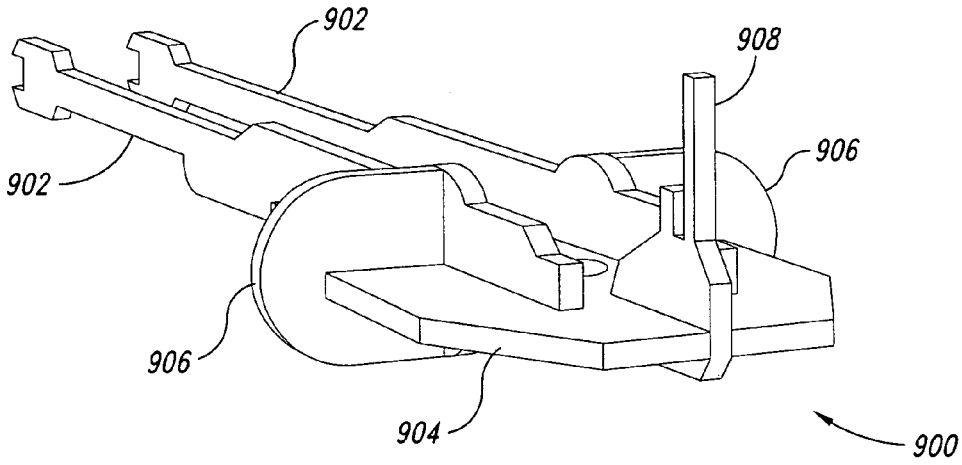
FIG. 9A is an isometric view of a gun that may be employed with the vehicles of FIG. 7A or 8H.
Figure 9B:
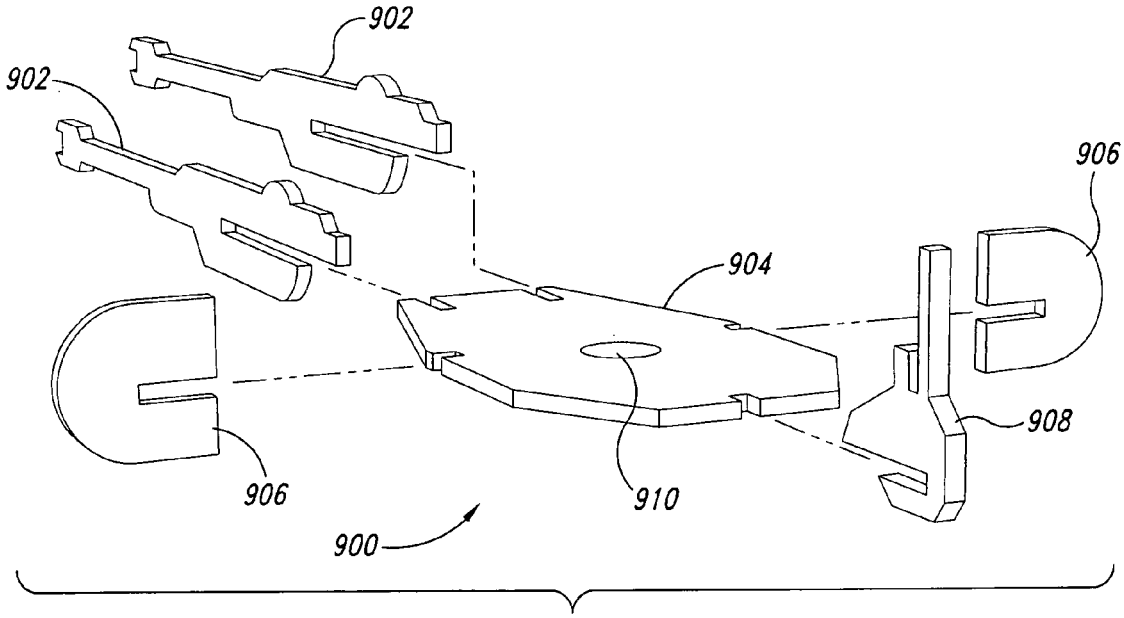
FIG. 9B is an isometric view of the gun of FIG. 9A.

FIGS. 9A and 9B show the gun 900 in greater detail. As shown, the gun 900 includes a pair of barrels 902 secured to a base 904. A pair of side elements 906 and a rear element 908 also secures to the base 904. A mounting hole 910 allows the gun to be removably secured to the gun mount 710 of the vehicle 700.

Figure 10A:
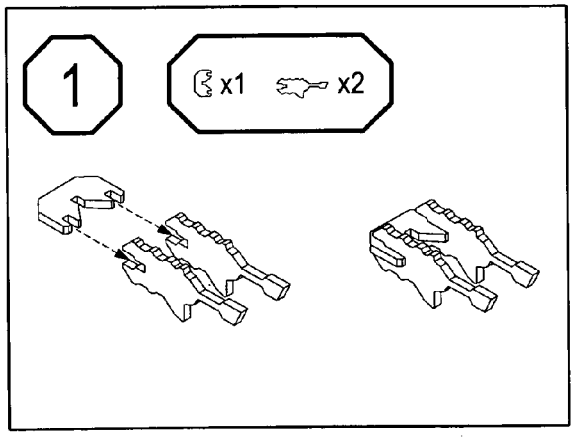
FIGS. 10A and 10B are isometric views of the sequential steps involved in assembling another gun by way of several generally two-dimensional pieces.
Figure 10B:
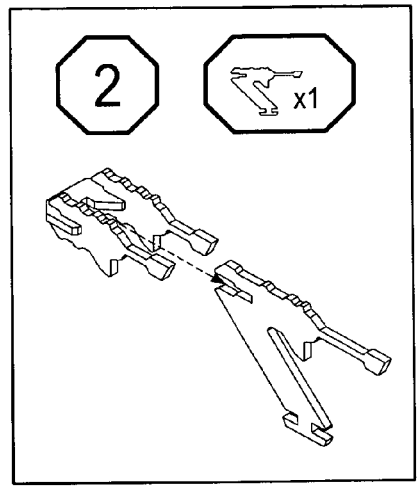
Figure 10C:
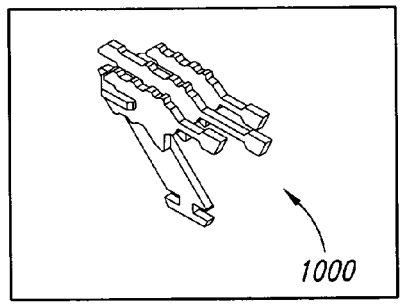
FIG. 10C is an isometric view of the gun assembled under the steps of FIGS. 10A and 10B.

Of course, other guns or weapons are possible, FIGS. 10A and 10B show the steps to be performed in assembling a gun 1000 from four pieces. FIG. 10C shows the assembled gun 1000.

FIGS. 11A through 11E and 12A through 12E show an example of how the same set of pieces may be assembled in two different configurations to produce two different randomizers that may provide different odds. FIGS. 11A through 11D show how the pieces may be assembled to form a roughly symmetric cube randomizer 1100, shown assembled in FIG. 11E, while FIGS. 12A through 12D show how those same pieces may be assembled to form a frustum randomizer 1200, shown assembled in FIG. 12E.

Figure 11A:
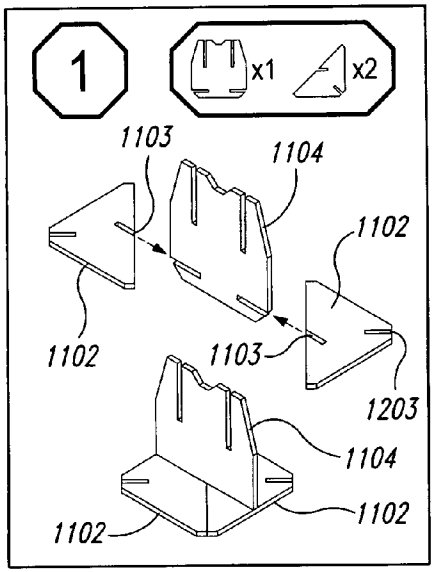
FIGS. 11A through 11D are isometric views showing the sequential steps in assembling a randomizer using a variety of generally two-dimensional pieces.
Figure 11B:
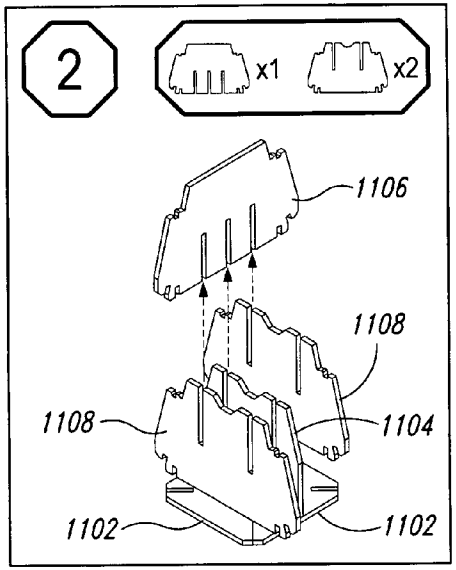
Figure 11C:
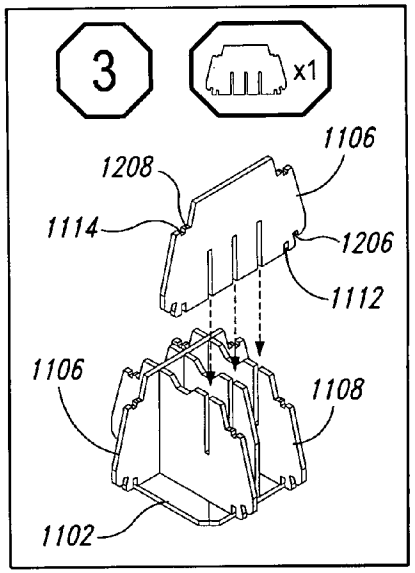
Figure 11D:
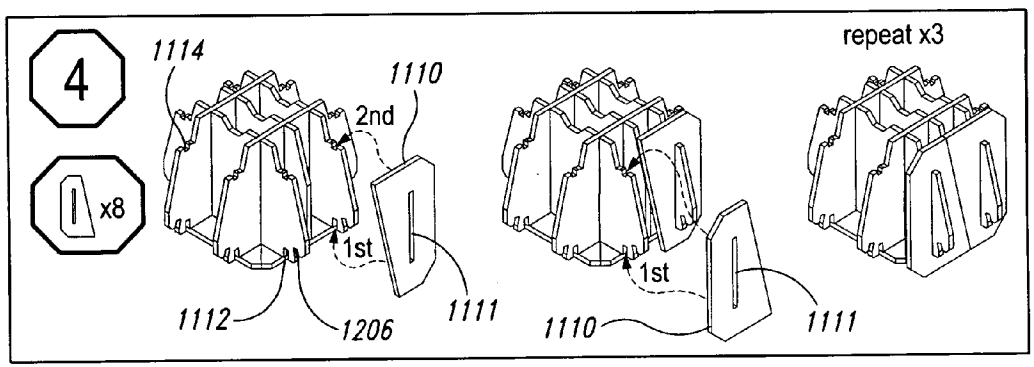
Figure 11E:
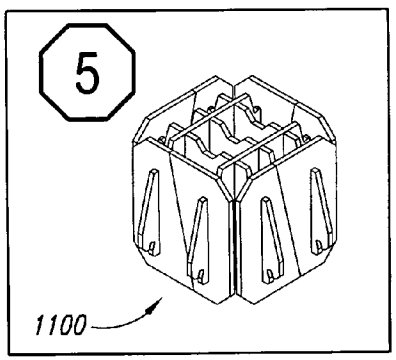
FIG. 11E is an isometric view of the assembled randomizer produced under the steps illustrated in FIGS. 11A through 11D.

Referring to FIG. 11A, two base pieces 1102, each having a first slot 1103, are inserted into an upright piece 1104. As shown in FIG. 11B, a pair of side upright pieces 1108 are positioned on opposite sides of the upright piece 1104, and a side upright piece 1106 is used to hold pieces 1104 and 1108. A second side upright piece 1106 is then inserted, as shown in FIG. 11C. A pair of side pieces 1110 are then secured to each side of the cube randomizer 1100, as shown in FIG. 11D. Importantly, a central slot 1111 is secured to a first lower slot 1112, and an upper edge 1114 of the upright pieces 1108. This is repeated three times to form the resulting, assembled cube randomizer 1100.

Figure 12A:
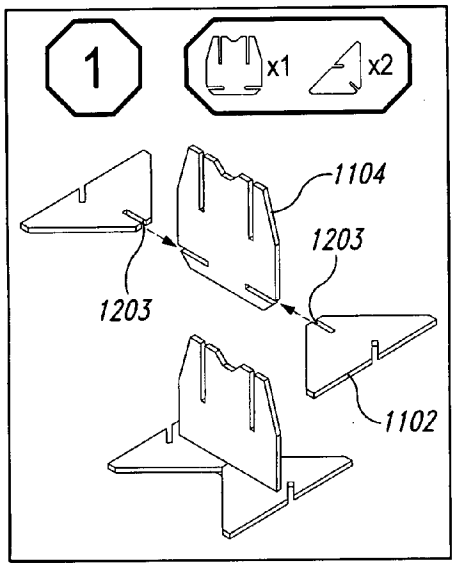
FIGS. 12A through 12D are isometric views showing the sequential steps for assembling another randomizer using the pieces of FIGS. 11A through 11D.
Figure 12B:
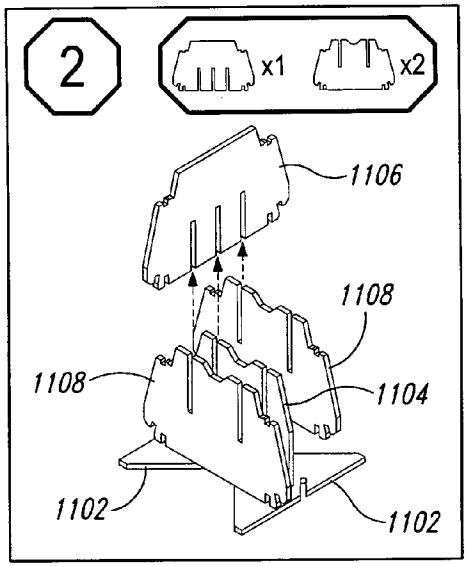
Figure 12C:
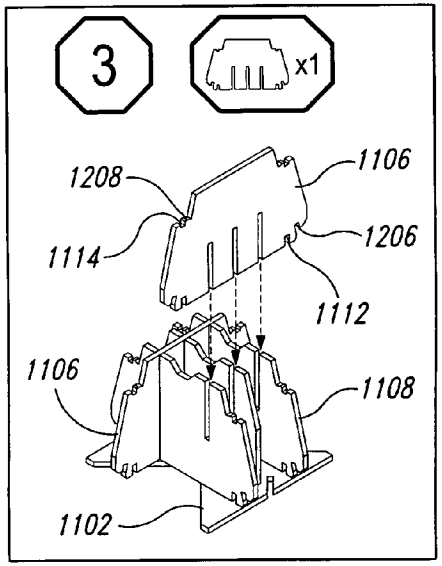
Figure 12D:
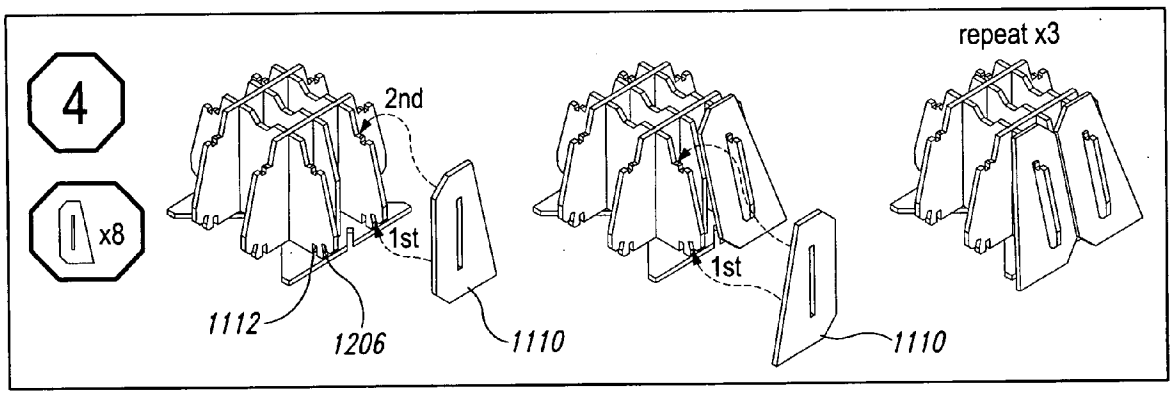
Figure 12E:
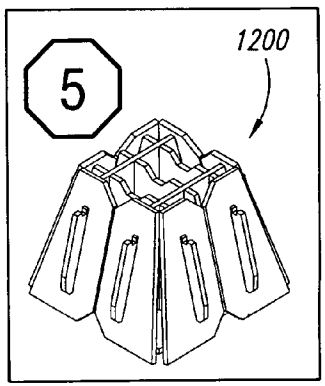
FIG. 12E is an isometric view of the randomizer assembled under the steps of FIGS. 12A through 12D.

Referring to FIG. 12A, the same pair of lower pieces 1102 are assembled using a second slot 1203 with respect to the upright piece 1104. The steps shown in FIGS. 12B and 12C are identical to those with respect to FIGS. 11B and 11C, respectively. As shown in FIG. 12D, however, the central slots 1111 of the side pieces 1110 are secured to a second lower slot 1206 and a second upper edge 1208. Again, this is repeated three more times, to produce the final, assembled frustum randomizer 1200, shown in FIG. 12E. Self-adhesive stickers preprinted with numbers for a randomizer, or other information, may be provided to be applied to the final, assembled randomizer. (Such self-adhesive labels may also be applied to portions of any model.)

Figure 13A:
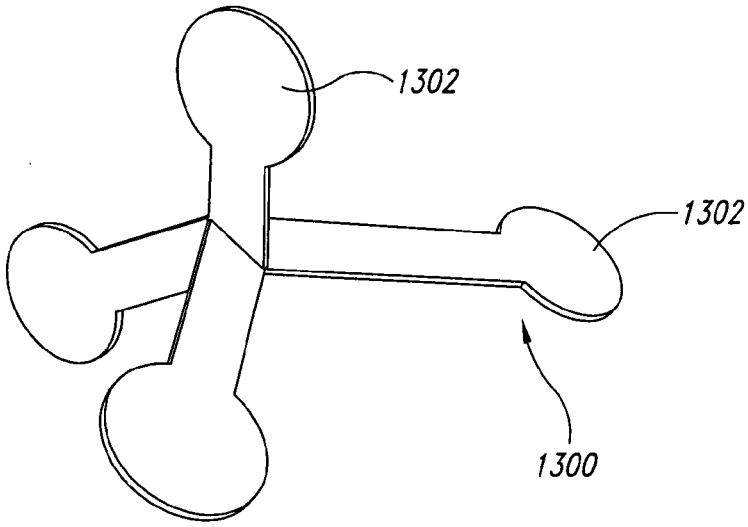
FIG. 13A is an isometric view of an alternative embodiment to the above randomizers.
Figure 13B:
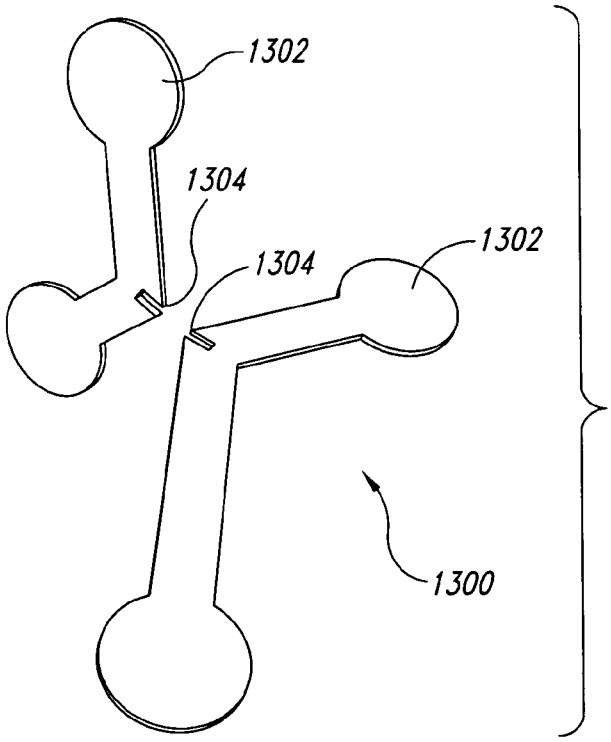
FIG. 13B is an exploded isometric view of the randomizer of FIG. 113A.

Very simple randomizers are also possible. As shown in FIGS. 13A and 13B, a simple randomizer 1300 is formed by a pair of identical flat pieces 1302 that secure together by way of mating slots 1304. The randomizer 1300 produces one of four possible values, dependent upon which of four round ends project upwardly when the randomizer is thrown and comes to rest on a surface.

Alternatively, complex randomizers, such as that shown in FIG. 51 are possible. Other complex randomizers include a pachinko-style device having a ball, pins or deflectors for randomly directing a ball along multiple paths, and bins associated with a value into which the ball falls. A hopper-style randomizer may include multiple balls or other objects, each with a value. Actuating the hopper causes one of the balls to be produced.

Figure 14A:
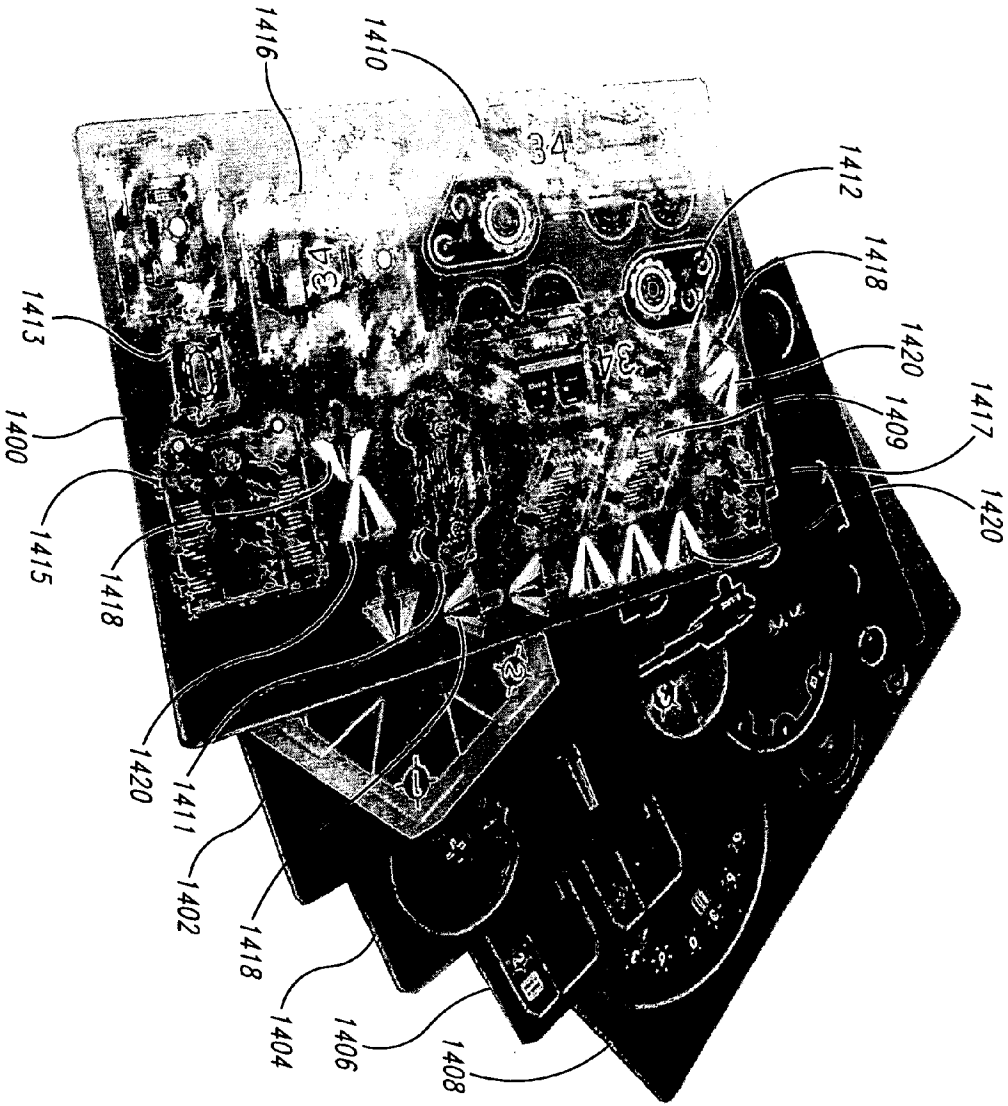
FIG. 14A is a digital photograph of an example of five cards that may be packaged together as a single unit, with a single card having pieces for assembling a vehicle with armor, and four cards each having at least one gun, randomizer, or both.
Figure 14B:
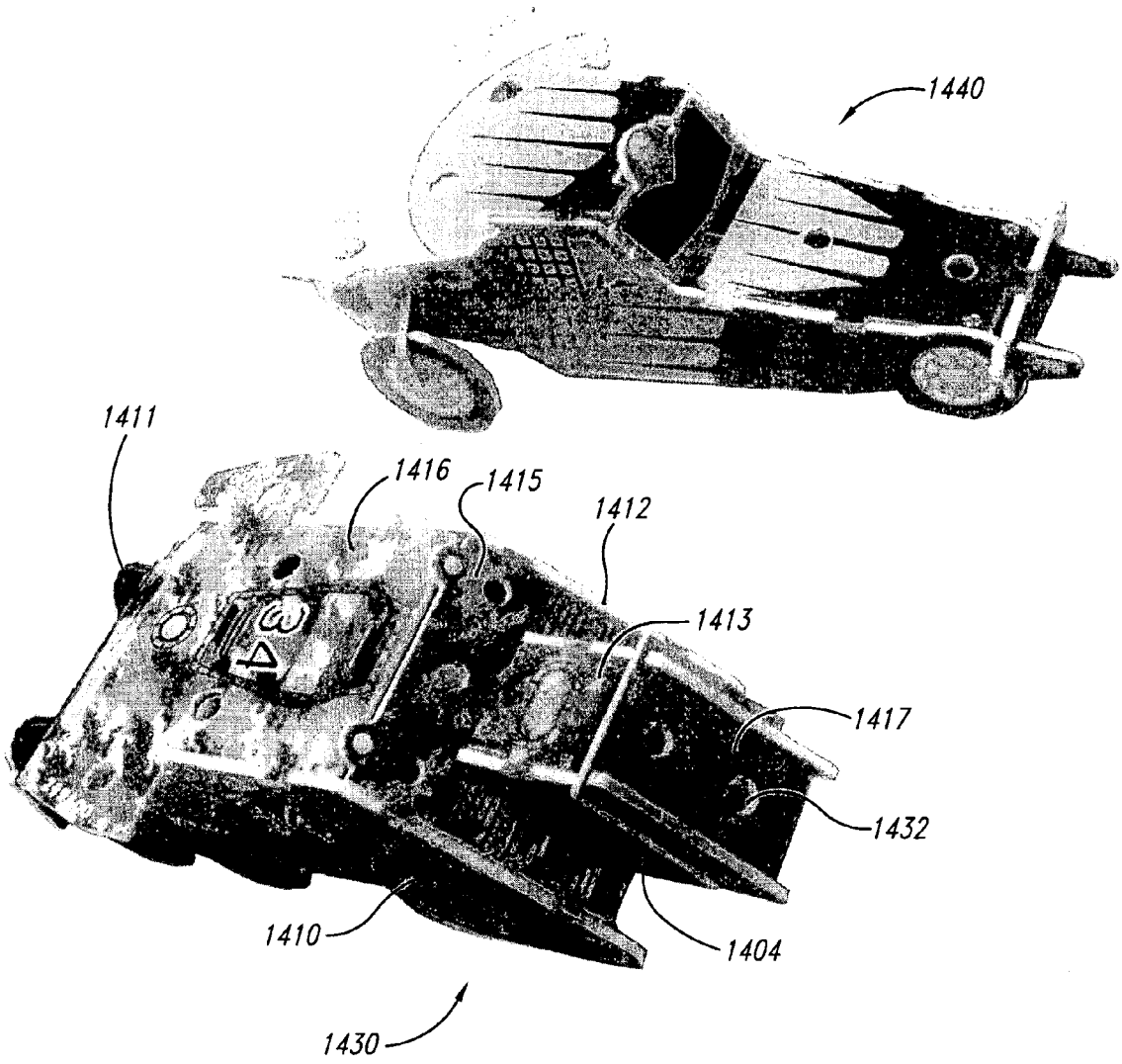
FIG. 14B is a digital photograph of the assembled vehicle of FIG. 14A, together with an example of another vehicle.
Figure 14C:
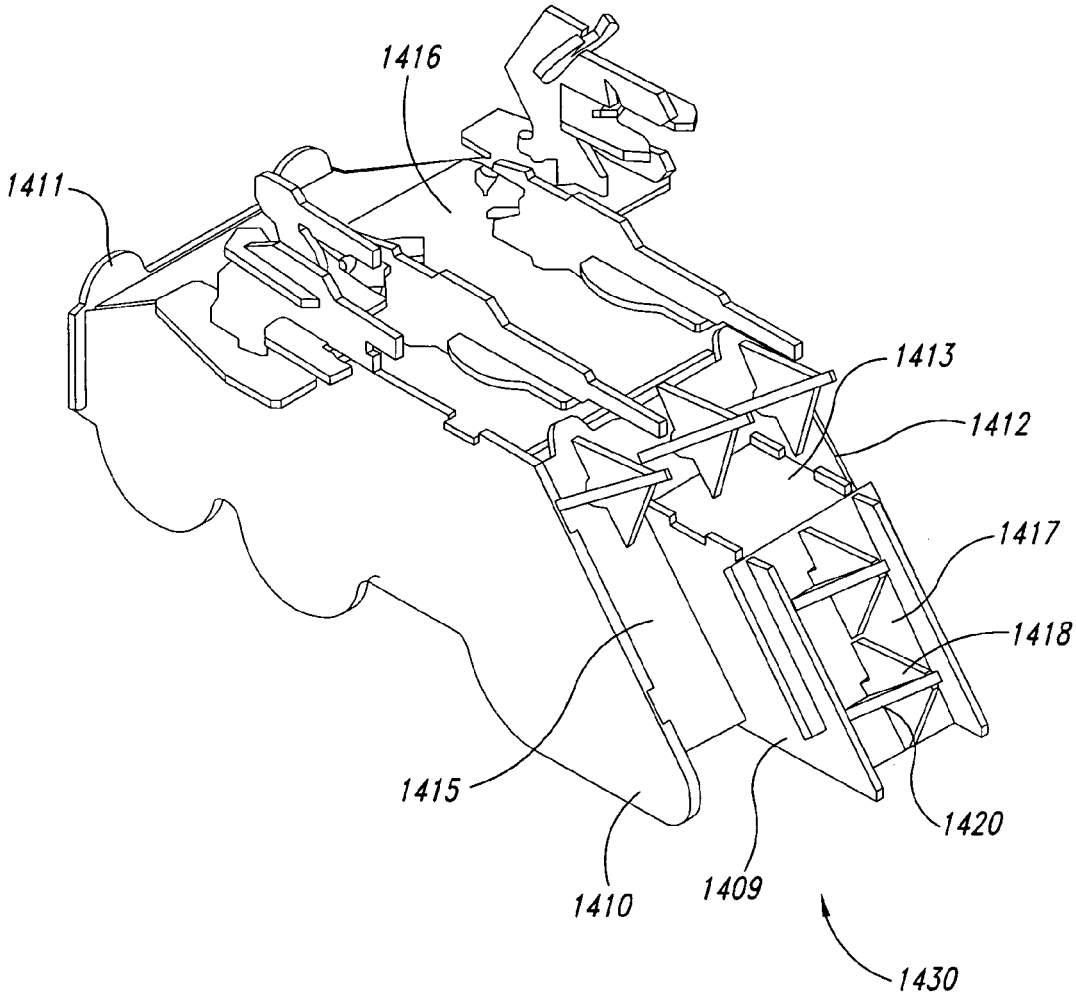
FIG. 14C is an isometric view of the vehicle of FIG. 14B, with guns and armor mounted thereto.

FIG. 14A shows an example of a pack of cards that may be distributed as a unit. The pack includes a vehicle card 1400, and four roller/weapon cards 1402, 1404, 1406 and 1408. Each of the roller/weapon cards includes pieces to assemble a randomizer or roller and associated weapon, as described herein. As shown in FIGS. 14B and 14C, the vehicle card 1400 includes pieces 1409, 1410, 1411, 1412, 1413, 1414, 1415, 1416 and 1417 that may be assembled as a vehicle 1430. (Another vehicle 1440 is shown in FIG. 14B.)

Armor pieces 1418 and 1420 are assembled as pairs to form "spikes," shown in FIG. 14C. The assembled armor spike is inserted into a hole 1432 (FIG. 14B). Each of the armor pieces 1418 and 1420 represents a single point of armor, so that under game play, if one point of armor is lost, one of the pieces is removed. Likewise, both pieces 1418 and 1420 are removed if the vehicle suffers two points of damage.

Figure 14E:
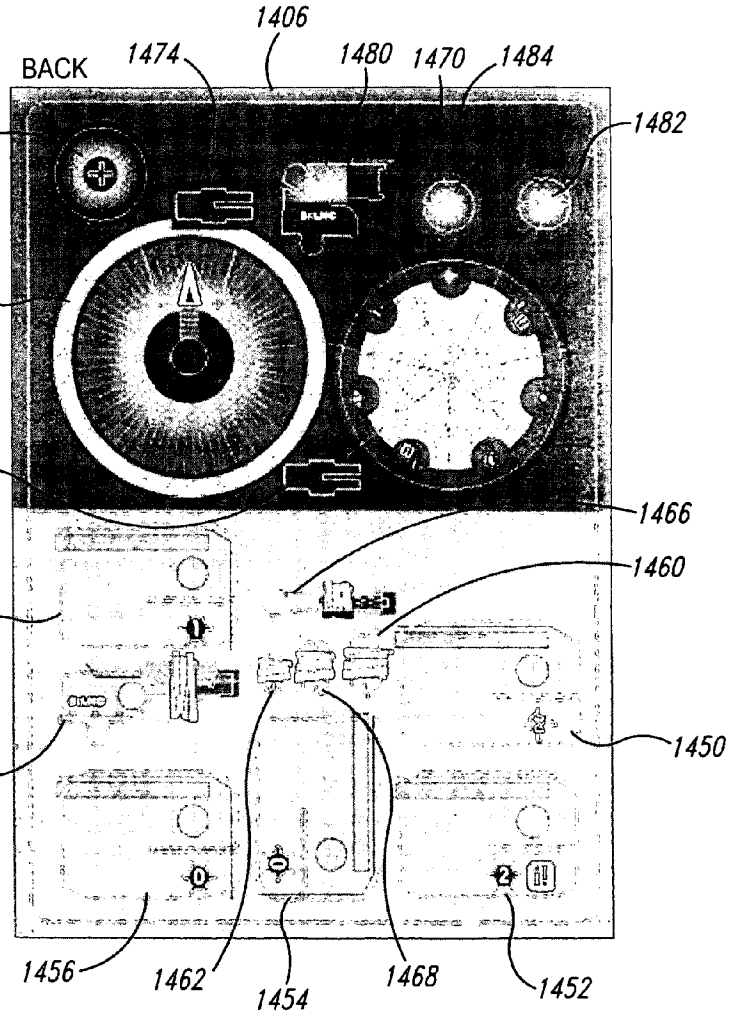
FIGS. 14D and 14E are respective front and back top plan views of one of the four gun/randomizer cards of FIG. 14A.
Figure 14D:
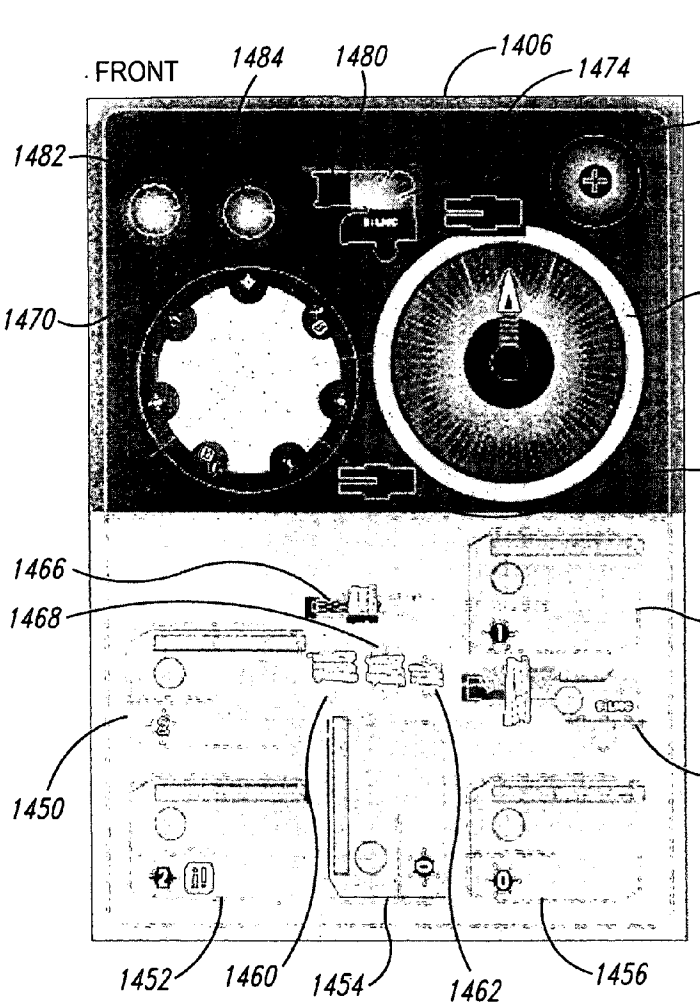

FIGS. 14D and 14E show opposite sides of the weapon/roller card 1406. As shown, pieces 1450, 1452, 1454, 1456 and 1458 are assembled to form a roller-type randomizer that is associated with a weapon consisting of pieces 1460, 1462, 1464, 1466 and 1468. Each of these pieces may share a similar base color to visually connote the connection between weapon and its associated randomizer. A spinner-type randomizer is assembled from pieces 1470, 1472, 1474, 1476 and 1478, which is associated with a weapon consisting of pieces 1480, 1482 and 1484. As shown, the card 1406 includes two weapons and two randomizers.

Figure 15A:
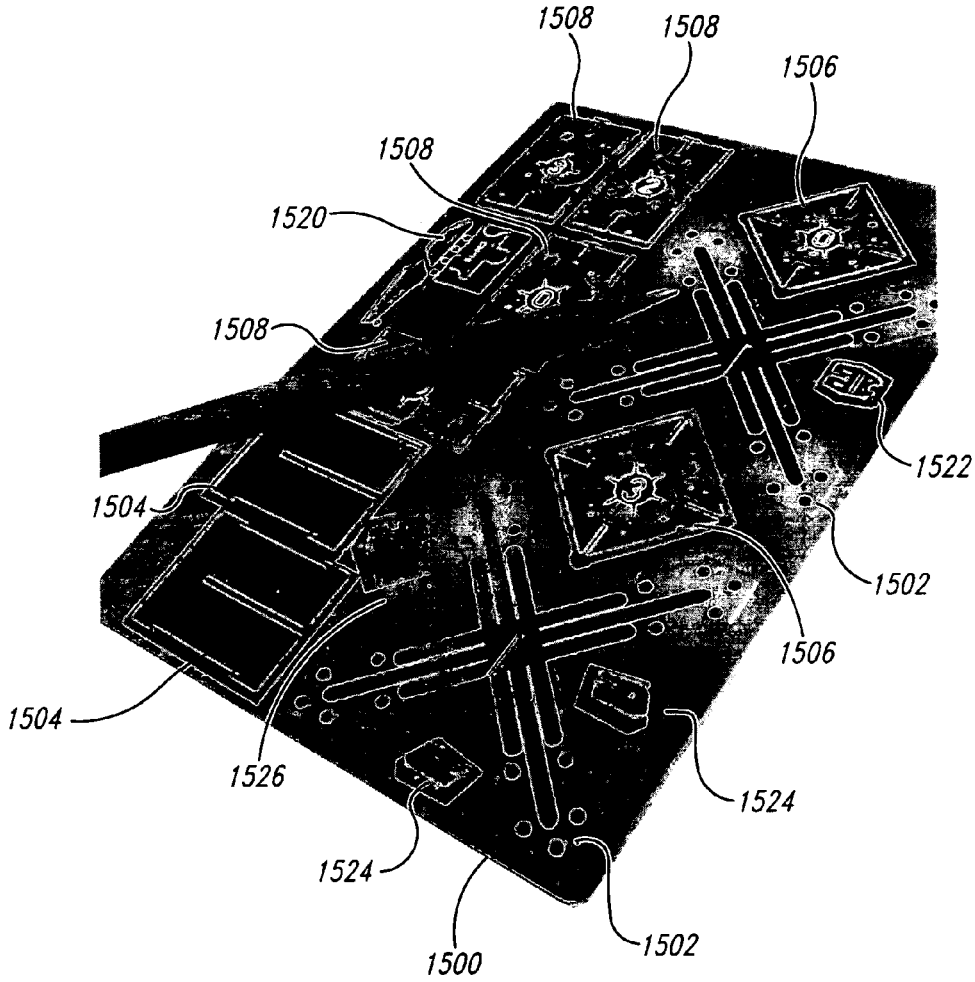
FIG. 15A is a digital photograph of a weapon and randomizer card.
Figure 15B:
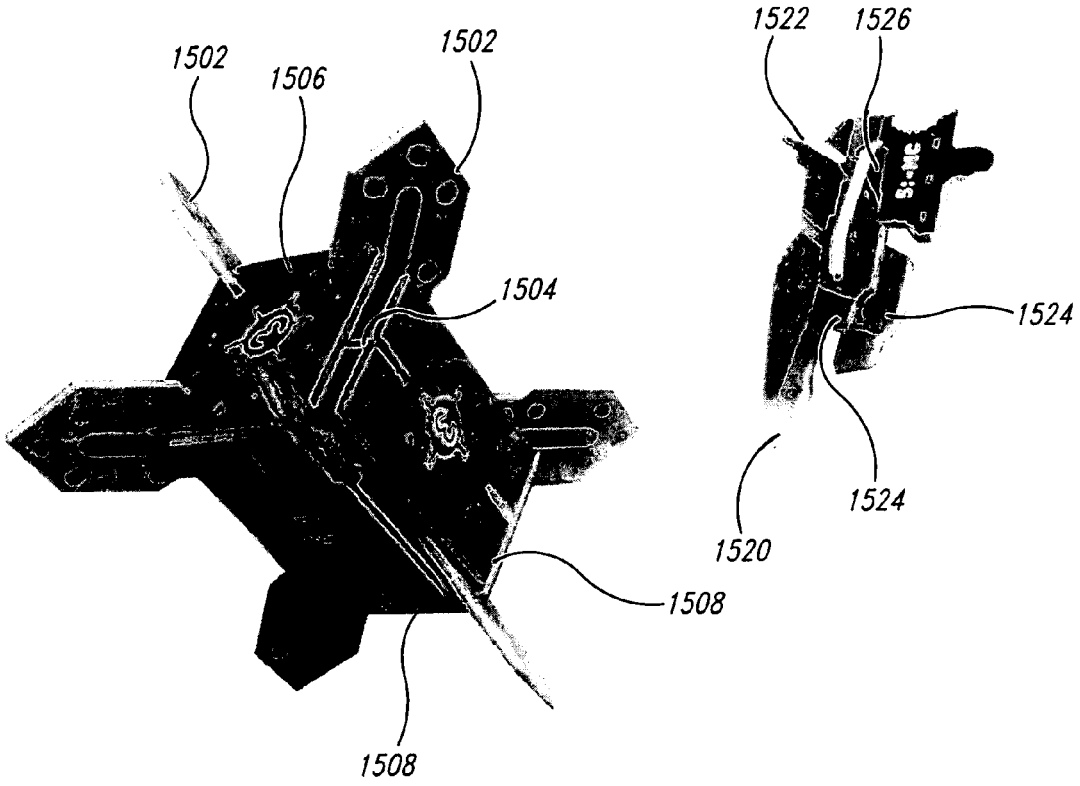
FIG. 15B is a digital photograph of the assembled weapon and randomizer of FIG. 15A.

FIGS. 15A and 15B show another example of a randomizer/weapon card 1500. Here, pairs of pieces 1502 and 1504 form the base of a roller-type randomizer, with top faces 1506 and side faces 1508 forming a balance of the randomizer. An associated weapon is constructed of pieces 1520, 1522, 1524 (two pieces) and 1526.

FIG. 16 shows an example of a table or key associated with symbols on randomizers and the affect a given symbol has on game play. Any particular card (or "silhouette") may have several different graphics (or "skins") applied thereto to represent different factions, as noted herein. Different printings may associate different odds with a given randomizer.

In general, users may assemble vehicles in any fashion they wish, as long as the rules of play are not violated. For example, a weapon may be assembled in a variety of configurations, as long as a weapon of five pieces continues to have five pieces (although, in alternative embodiments, rule modifications may be made or rules violated). In lieu of the armor consisting of individual or interconnected pieces affixed to a vehicle, armor points may be represented and tracked by way of a rotating dial associated with, or secured to, a given vehicle to track loss of armor points during game play.

Under the game, trade-offs may be associated with vehicles, such as speed verses armor. A vehicle with numerous armor points may have a slower speed, while another vehicle may have a higher speed, but lower armor points. Likewise, one weapon may provide (via its associated randomizer) more frequent hits, but with less damage, than another weapon that more infrequently hits, but when it does hit, it provides more damage. In addition to matching a weapon to its randomizer by way of color, a matching code, texture or other motif may be employed.

Weapons may have ranges consisting of long, medium and close. Each weapon would have the capacity to fire at one or more range. Once per range, each player is allowed to initiate an attack on his opponent's vehicle using one weapon capable of functioning at the then current range. Ranges for each weapon may be written on a base of the weapon. For example, "LMC" may represent a weapon that fires at long, medium and close range, while "L-" is a long-range weapon and "L-C" represents a weapon with only long and close-range capability. More details regarding the game mechanic and game player are discussed below.

Suitable Game Mechanic Using Model-Building Toy

An example of a game associated with the assembled toy robots will now be described. In this example, each model of the robot has one body and four guns. A player wins by destroying all guns on an opponent's robot. The robot may have some additional components, such as a number of pieces of armor with an associated speed rating. The more armor a robot has, the slower its speed; however, the more difficult it will be for an opponent to destroy that robot's guns or components, or even pieces of the robot.

As noted above, each gun is made of one or more pieces and has an associated randomizer (e.g., a roller, die, spinner, or some other suitable device). Different guns are made of different numbers of pieces, with better (and often more rare) guns having fewer pieces and inferior guns having more pieces, or vice versa. Better guns may also be defined by other criteria, not necessarily the number of pieces used in its construction. In general, accessories may involve multiple pieces that are themselves assembled as models. As noted herein, guns or other components may have associated randomizers, thereby leading to numerous components and associated randomizers beyond the handful of those depicted in the figures. As also noted herein, certain components are rare, and are not limited to guns. For example, in the robot example described herein, armor, or certain types of armor, may be rare in their distribution.

Each turn, the player whose robot is faster shoots a gun at the other player's robot, and then the slower robot shoots back. To shoot a gun, the player manipulates or rolls the randomizer. The randomizer tells whether that gun scores a hit, and if so, how much damage the gun deals with that shot. The other player has to remove pieces from his or her gun, or from the armor, with one piece for each point of damage and all the points associated with the same gun or the same armor. When a gun or piece of armor is out of pieces, it is destroyed. Extra damage (more than is needed to destroy the gun or the armor) is wasted. The defending player chooses which gun (or armor) takes the damage.

As noted above, each gun has one of three ranges: long, medium or close. Long-range guns shoot at any range, medium guns shoot at medium or close range, while close-range guns may only shoot at close range. To offset the advantage a long-range gun has over a close range gun, the long-range gun may provide less damage than that of the close range gun. Players exchange shots at long range, then medium, then close, and then they start over at long range again. In addition to dealing damage, guns sometimes have special effects, as indicated by symbols that appear on the randomizers or guns. One example of a special effect is a "bulls-eye," which lets the attacker choose which gun (or armor) is damaged, instead of the defender choosing. Game play continues until one player has destroyed all guns (or armor) from the opposing player's robot.

This is only one example of game play, and various other game mechanics may be employed. As noted above, rollers and the guns to which they are linked may provide more consistent results, and may be more desirable for advanced players. The rollers (and the guns to which they are linked) that roll for bigger numbers are more desirable to beginning players. Simpler roller designs, such as those having fewer pieces that snap together in intuitive ways, are more common. Conversely, the more pieces and the more detailed and original the design, the rarer the gun and associated roller in overall distribution of game elements.

Another example of game play involves plastic cards, as noted above, where the user punches out various shapes to build vehicles, weapons, and randomizers. Each player competes his or her vehicle in a series of jousting contests. After each contest, the player may rebuild his or her vehicle with different weapons, as described herein.

Each weapon may be constructed using between 2 to 8 pieces. The number of pieces to a fully constructed weapon represent its "hit points," or how many points of damage it can receive before it is removed from the game. As a weapon receives damage pieces are removed from the weapon model. When the final piece receives damage, the model is then completely removed from the chassis and that weapon's randomizer is likewise removed from the game.

Under this example, each vehicle includes a chassis with universal mounts for various weapons, where each chassis can use every weapon, and certain weapons are associated with certain randomizers. The vehicles, guns and randomizers of FIG. 7A through 13B are examples of vehicles, guns and randomizers that may be employed in this example. The gun 900 may be associated with the randomizer 1300, while the gun 1000 may be associated with the randomizer 1100 if mounted to the vehicle 700, and the randomizer 1200 if associated with the vehicle 800.

A few base chassises or models may be created, but printing for those models may differ significantly. For example, different colored vehicles may represent different factions, clubs or groups. For example, a camouflage colored tank may be associated with the military faction, whereas the same tank may also be printed in a colorful or tie-dye manner so as to be associated with a hippie faction. The military faction vehicles may be printed and distributed different camouflage colors, while the different hippie versions may have different tie-dye colors, and so forth. Some colors of the same vehicle may be more rare, and thus have greater collectability, than vehicles printed in other colors.

Players may exchange components between different colored models, for example, if the player had both red and yellow tanks, the player could put the red treads on the yellow tank. In this way, players may personalize or customize their vehicles.

During game play, players may substitute distressed or damaged components when the vehicle takes damage. For example, rather than removing a given component from a vehicle, the player can instead substitute a damaged version of that component on the vehicle (e.g., substituting a damaged gun for a working gun).

Additional Considerations and Alternatives

"Flavor" information creates allegiance to different factions and personalities for the game. For example, robots may be color-coordinated or have designs affiliating them with a particular team or group, so that players may collect robots (and modular accessories) associated with that group. Additional information packaged with the cards may allow players to learn details about the fictitious world or environment in which the robots operate or originate (social currency). Thus, players want to gather more information about this fictitious world to enrich their playing experience. Premium treatments may be applied to certain cards to enhance collectibility, such as foil overlay to provide a shiny appearance to certain robots or components, holographic printing on pieces, over-or under-printed treatments, transparent or translucent plastics, and textured sheet plastics.

Models may be made from sheetmetal, wood, or other materials. Of course, the models need not be assembled from flat base material. Instead, generally three-dimensional injected molded plastic parts may be employed, although the volume of the packaging may necessarily increase.

Collation is employed during the manufacturing process to determine which cards go in which packs, where a given pack would include, for example, one or more cards to assemble a robot, with one or more cards for a gun and associated roller. The packs may be boxes or plastic packaging that obscures the contents so that a purchaser is unaware of which model is enclosed until the pack is opened. (The packs may be formed of any suitable packaging material to secure the various components together as a unit for distribution and sale.) The collation process provides randomness to the distribution of the cards, with some fixed insertions, such as rules.

Overall, the game creates a repeat purchase incentive by making models customizable with modular components or pieces. Adding game play under the rules, and strategic construction choices for players, extends the play experience. Many game activities may be provided, such as promotions, organized game play allowing players to play others in a convention, and publications associated with the game.

The game may be manufactured at low cost and distributed in prepackaged sets of cards at specialty gaming stores, comic book stores, card stores, etc., as well as at mass market retailers, such as supermarkets, convenience stores and large toy retailers.

Each pack may contain three to six cards, with one chassis or model card that represents the main part or base of a robot to which the weapons, accessories or other components are attached. Rare chassis may have slots for more or better weapons. Each pack would also include two to four weapons or accessory cards where each accessory card has one or two punch-out weapons, etc., that the user assembles and adds to the chassis. Each weapon has a corresponding roller that may be formed on the same punch-out card. A rule sheet and checklist may also be included. Importantly, only a single stock keeping unit (SKU) need be provided. This limits the amount of shelf area a retailer needs to commit to try out the product. It also limits the cash output the retailer needs to invest and the customer needs to expend to try out the game.

By randomizing certain game components or elements, such as certain rare robots, guns, and armor, as well as providing premium treatment, users may be motivated to purchase more packs of the cards in an attempt to obtain such rare components.

In sum, the game allows for a small footprint within a retail location, with low inventory risk. The game encourages repeat purchases due to the premium treatments, random distribution of components, etc. Further, the game has a gadget factor and modularity that encourage customization and repeat purchases.

The modularity may work on many levels. As described above, one example is by having different sized or shaped slots in robots, into which only certain guns or accessories will fit. Such physical limitations, such as slots shaped like an X, a dashed series of slots having different series (e.g., slot patterns "- - -", "- ---- -", etc.), and the like provide some game balance to allow only some accessories to be accepted on certain robots. Colors or symbols may be used as both a cosmetic criterion, and a way to limit interchangeability of certain accessories with certain robots.

Users can express individuality by assembling robots in different ways due to the modularity of the components. Building choices change the way the game is played, because different guns or accessories have corresponding randomizers that differ and provide game balance. Users can build the model and play a game associated with that model with a relatively low cost and over a relatively short duration. Pieces are portable and semidisposable, and it is inexpensive to improve or add on to game components.

Collectibility may be enhanced by providing rarity (limited distribution of certain game components); certain game play statistics; "flavor" statistics (such as the colors or groupings of robots); rare components having more interesting "roller" design; rare components having more detailed and more interesting-looking accessories and chassis; rare chassis designs having more versatility with game play options; and premium treatments, such as those described above. These are only some of the features and benefits of the embodiments described above.

While the game is been generally described herein as employing physical models, virtual or computer-generated models may be employed, with the game being conducted on one or more computers or wireless devices (such as mobile phones). In one example, the game is performed in an online or Internet-based environment. Players purchase models, where each model may be unique (e.g., have an associated electronic serial number). Players may, via their computer, customize the model, by adding or subtracting parts, changing colors, and so forth. Players may then battle each other over the Internet, where the randomizer function is performed using a random number generation routine. Players may trade online models with each other, buy and sell them, and win points through sanctioned online tournaments. In general, all of the above game mechanics may apply to a virtualized or electronic game, and thus need not have physical components associated with it.

Figure 17:
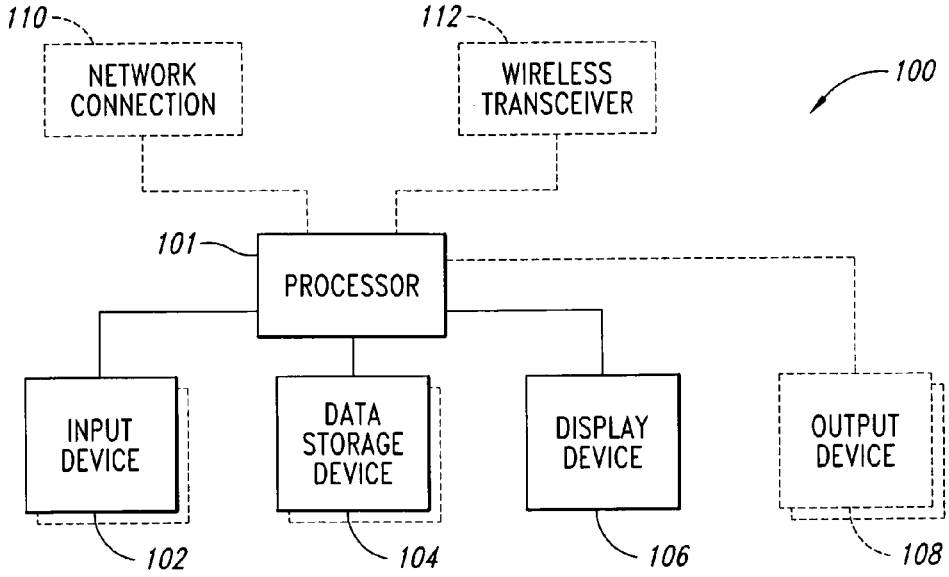
FIG. 17 is a block diagram of a suitable computer for employing aspects of the invention.

FIG. 17 and the following discussion provide a brief, general description of a suitable computing environment in which aspects of the invention can be implemented. Those skilled in the relevant art will appreciate that aspects of the invention can be practiced with various computer system configurations, including Internet appliances, hand-held devices, wearable computers, cellular or mobile phones, multi-processor systems, microprocessor-based or programmable consumer electronics, set-top boxes, network PCs, personal/desktop computers, laptop/portable computers, mini-computers, mainframe computers and the like. Aspects of the invention can be embodied in a special purpose computer or data processor that is specifically programmed, configured or constructed to perform one or more of the computer-executable instructions explained in detail below. Indeed, the term "computer," as used generally herein, refers to any of the above devices, as well as any data processor.

Referring to FIG. 17, one embodiment of the invention in an electronic environment employs a computer 100 having one or more processors 101 coupled to one or more user input devices 102 and data storage devices 104. The computer is also coupled to at least one output device such as a display device 106 and one or more optional additional output devices 108 (e.g., printer, plotter, speakers, tactile or olfactory output devices, etc.). The computer may be coupled to external computers, such as via an optional network connection 110, a wireless transceiver 112, or both.

The input devices 102 may include a keyboard and/or a pointing device such as a mouse. Other input devices are possible such as a microphone, joystick, pen, game pad, scanner, digital camera, video camera, and the like. The data storage devices 104 may include any type of computer-readable media that can store data accessible by the computer 100, such as magnetic hard and floppy disk drives, optical disk drives, magnetic cassettes, tape drives, flash memory cards, digital video disks (DVDs), Bernoulli cartridges, RAMs, ROMs, smart cards, etc. Indeed, any medium for storing or transmitting computer-readable instructions and data may be employed, including a connection port to a network such as a local area network (LAN), wide area network (WAN) or the Internet (not shown in FIG. 17).

As noted above, aspects of the invention can also be practiced in other computing environments, such as distributed computing environments where certain tasks or modules are performed by remote processing devices and which are linked through a communications network, such as a Local Area Network ("LAN"), Wide Area Network ("WAN") or the Internet. In a distributed computing environment, program modules or sub-routines may be located in both local and remote memory storage devices. Aspects of the invention described herein may be stored or distributed on computer-readable media, including magnetic and optically readable and removable computer disks, hard-wired or preprogrammed in chips (e.g., EEPROM semiconductor chips), as well as distributed electronically over the Internet or over other networks (including wireless networks). Those skilled in the relevant art will recognize that portions of the invention may reside on a server computer or a network of server computers, while other portions reside on a client computer or a network of client computers. Data structures and transmission of data particular to aspects of the invention are also encompassed within the scope of the invention. In general, while hardware platforms, such as the personal computer 100 and remote computer 150, are described herein, aspects of the invention are equally applicable to nodes on a network having corresponding resource locators to identify such nodes.

Figure 18:
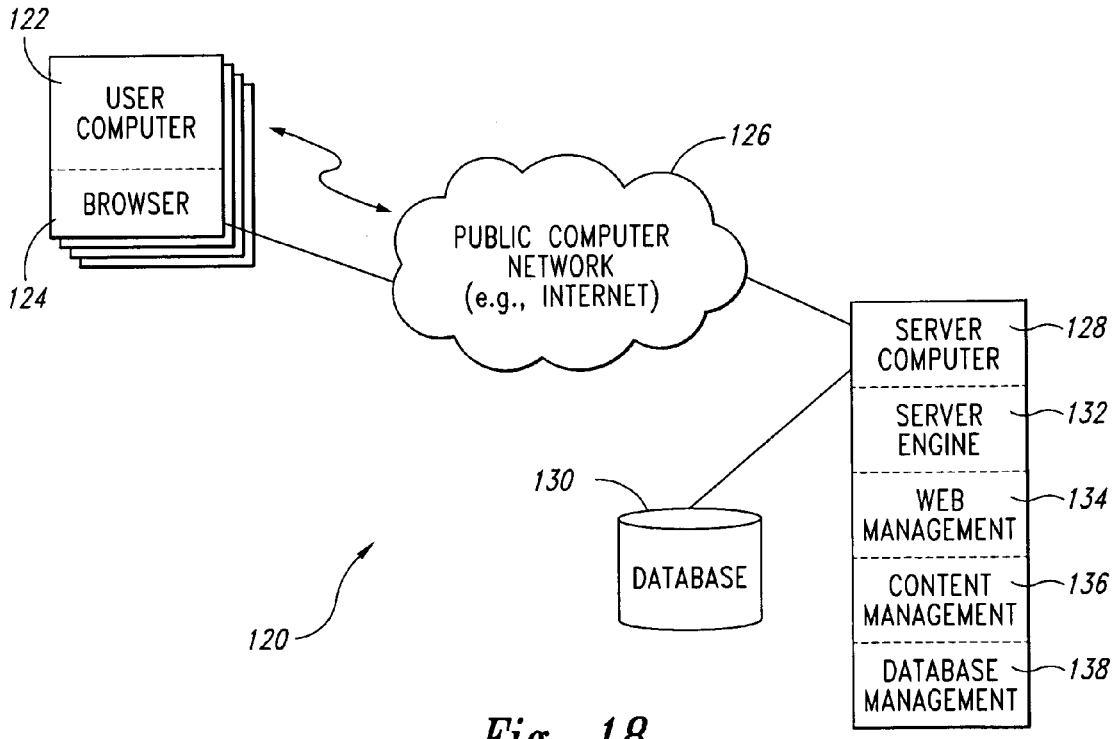
FIG. 18 is a block diagram illustrating a suitable system in which aspects of the invention may operate in a networked computer environment.

Referring to FIG. 18, a distributed computing environment with a web interface includes one or more user computers 122 in a system 120 are shown, each of which includes a browser program module 124 that permits the computer to access and exchange data with the Internet 126, including web sites within the World Wide Web portion of the Internet. The user computers may include one or more central processing units or other logic-processing circuitry, memory, input devices (e.g., keyboards and pointing devices), output devices (e.g., display devices and printers), and storage devices (e.g., magnetic, fixed and floppy disk drives, and optical disk drives), such as described above with respect to FIG. 17. User computers may include other program modules such as an operating system, one or more application programs (e.g., word processing or spread sheet applications), and the like. The user computers 122 include wireless computers, such as mobile phones, personal digital assistants (PDA's), palm-top computers, etc., which communicate with the Internet via a wireless link. The computers may be general-purpose devices that can be programmed to run various types of applications, or they may be single-purpose devices optimized or limited to a particular function or class of functions.

At least one server computer 128, coupled to the Internet or World Wide Web ("Web") 126, performs much or all of the functions for receiving, routing and storing of electronic messages, such as web pages, audio signals and electronic images. While the Internet is shown, a private network, such as an intranet may likewise be used herein. The network may have a client-server architecture, in which a computer is dedicated to serving other client computers, or it may have other architectures such as a peer-to-peer, in which one or more computers serve simultaneously as servers and clients. A database 130 or databases, coupled to the server computer(s), stores much of the web pages and content exchanged between the user computers. The server computer(s), including the database(s), may employ security measures to inhibit malicious attacks on the system, and to preserve integrity of the messages and data stored therein (e.g., firewall systems, secure socket layers (SSL) password protection schemes, encryption, and the like).

The server computer 128 may include a server engine 132, a web page management component 134, a content management component 136 and a database management component 138. The server engine performs basic processing and operating system level tasks. The web page management component handles creation and display or routing of web pages. Users may access the server computer by means of a URL associated therewith. The content management component handles most of the functions in the embodiments described herein. The database management component includes storage and retrieval tasks with respect to the database, queries to the database, and storage of data such as the models, component parts, accessories, and other game aspects noted above.

CONCLUSION

The above detailed descriptions of embodiments of the invention are not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while the game is described above with one example of game play and components, various other options are possible. Rather than employ robots or vehicles, an outer space theme game may employ models as space ships, which have slots configured to receive different weapons or other accessories. Likewise, the game may employ a fantasy theme, with the chassis or base representing creatures or characters and the accessories representing weapons or other devices that the characters may hold.

Furthermore, the game mechanic need not be centered on a combat theme. For example, the models may employ animals, such as ladybugs or kitty-cats, with components being accessories for the animals, such as purses, jewelry, etc. The randomizer would then be used to determine whether a player was successful in obtaining a goal, such as acquiring additional accessories, progressing toward a geographic or spatial destination, etc. Thus, educational, occupational, leisure or other non-combat themes may be employed.

Each component or accessory need not be a single element; instead, certain components may be assembled from two or more elements to become separate models to be used with a given character or chassis. Thus, those skilled in the relevant art will readily recognize that the teachings of the invention provided herein may be applied to other game themes or even other games, not necessarily the vehicle or robot-based game described herein.

The elements and acts of the various embodiments described above can be combined to provide further embodiments. All of the above patents, patent applications, and other references, including any that may be listed in accompanying filing papers, are incorporated herein by reference. Aspects of the invention can be modified, if necessary, to employ the elements, functions and concepts of the above patents, applications and references to provide yet further embodiments of the invention. These and other changes can be made to the invention in light of the above detailed description.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." In the above Detailed Description, words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Details of the game may vary considerably in its implementation details, while still be encompassed by the invention disclosed herein. As noted above, particular terminology used when describing certain features or aspects of the invention should not be taken to imply that the terminology is being re-defined herein to be restricted to any specific characteristics, features or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventors contemplate the various aspects of the invention in any number of claim forms. For example, while only one aspect of the invention is recited as embodied in a computer-readable medium, other aspects may likewise be embodied in a computer-readable medium. Accordingly, the inventors reserve the right to add additional claims after filing the application to pursue such additional claim forms for other aspects of the invention.

I claim:

1. A method of playing a game by first and second players, the method comprising:

providing at least first and second toy bases for use by respective first and second players, wherein each toy base comprises multiple components, wherein the multiple components of each toy base are formed as generally-planar pieces, wherein the generally-planar pieces are manually punched out or removed from at least one rectangular panel by at least one of the first and second players, and wherein each of the first and second toy bases represent at least a portion of a vehicle or robot;

manually assembling the first toy base by the first player;

manually assembling the second toy base by the second player;

removably securing at least one accessory to a location on the first toy base by the first player, wherein the accessory has use under predetermined rules of play;

removably securing at least one accessory to a location on the second toy base by the second player;

moving the first manually assembled toy base under the predetermined rules of play by the first player;

moving the second manually assembled toy base under the predetermined rules of play by the second player;

generating a first random number and playing the game according to the predetermined rules of play by the first player;

upon occurrence of an negative event under the predetermined rules of play and based at least in part on the first generated random number, then either (i) removing the accessory or one of the multiple components of the second toy base, or (ii) replacing the accessory or one of the multiple components of the second toy base with a substitute accessory or substitute component, respectively, wherein the substitute accessory or substitute component represents damage to the accessory or one of the multiple components; and generating a second random number and playing the game according to the predetermined rules of play by the second player;

upon occurrence of an negative event under the predetermined rules of play and based at least in part on the second generated random number, then either (i) removing the accessory or one of the multiple components of the first toy base, or (ii) replacing the accessory or one of the multiple components of the first toy base with a substitute accessory or substitute component, respectively; and repeating the generating of random numbers and the removing or replacing of accessories or components, under the predetermined rules of play, until one of the first or second players wins the game at least in part because of the removing of accessories or components from the toy base, or because of the replacing of the accessories or components on the toy base with substitute accessories or substitute components.

2. A method of playing a game by first and second players, the method comprising:

providing at least first and second toy bases for use by respective first and second players, wherein each toy base comprises multiple components, wherein the multiple components of each toy base are formed as generally-planar pieces, wherein the generally-planar pieces are manually punched out or removed from at least one rectangular panel by at least one of the first and second players, and, wherein the first and second toy bases are distributed as a set within a package that obscures the first and second toy based from a purchaser, and wherein the first and second toy bases are randomly collated from other toy bases in distribution;

manually assembling the first toy base by the first player;

manually assembling the second toy base by the second player;

moving the first manually assembled toy base under the predetermined rules of play by the first player;

moving the second manually assembled toy base under the predetermined rules of play by the second player;

generating a first random number and playing the game according to the predetermined rules of play by the first player;

upon occurrence of an negative event under the predetermined rules of play and based at least in part on the first generated random number, then either (i) removing one of the multiple components of the second toy base, or (ii) replacing one of the multiple components of the second toy base with a substitute component, wherein the substitute component represents damage to one component; and generating a second random number and playing the game according to the predetermined rules of play by the second player;

upon occurrence of an negative event under the predetermined rules of play and based at least in part on the second generated random number, then either (i) removing one of the multiple components of the first toy base, or (ii) replacing one of the multiple components of the first toy base with a substitute component; and repeating the generating of random numbers and the removing or replacing of components, under the predetermined rules of play, until one of the first or second players wins the game at least in part because of the removing of components from the toy base, or because of the replacing of the components on the toy base with substitute components.

3. The game method of claim 2, further comprising at least one piece of equipment and at least one random value generator, wherein the equipment is associated with a function under the rules of play, and wherein the function is associated with at least one predetermined value or symbol derived from the random value generator.

4. The game method of claim 2 wherein the generally-planar pieces are configured with mating slots and grooves to be assembled by hand.

5. The game method of claim 2, further comprising a set of self-adhesive labels for customizing the first or second toy bases.

6. The game method of claim 2 wherein the first toy base has a first set of graphics applied thereto, and wherein another toy base is substantially identical to the first toy base, but which has a second set of graphics applied thereto.

7. The game method of claim 2 wherein the first toy base is distributed in fewer quantities than the second toy base.

8. The method of claim 2 wherein each of the first and second toy bases represent at least a portion of a vehicle or robot.

9. The method of claim 2, further comprising first and second weapon accessories for use with the first and second toy bases, wherein the first and second weapon accessories are respectively associated with differing first and second ranges.

10. The method of claim 2 wherein a single stock keeping number is associated with the set and other sets of toy bases.

11. A method of playing a game, comprising:

defining a goal and a series of actions of play for achieving the goal between first and second players;

providing first and second models to be assembled by at least one of the first and second players, wherein each of the models comprises multiple components configured to be manually assembled without use of glue or permanent fasteners, wherein at least first and second predetermined subsets of the multiple components are configured to be readily removed and reattached to the respective first and second models, wherein the multiple components are formed within at least first and second panels of planar, substantially rigid material, and are configured to be manually removed from the first and second panels, and wherein the first and second panels each have a width-to-length ratio of approximately 5.5 to 8;

manually assembling the first model from the multiple components, including removably securing the first predetermined subset of components to the first model, wherein the first predetermined subset of components help in furthering the game goal;

manually assembling the second model from the multiple components, including removably securing the second predetermined subset of components to the first model, wherein the second predetermined subset of components help in furthering the game goal;

moving the first manually assembled model under at least one of the series of actions of play;

moving the second manually assembled model under at least one of the series of actions of play;

generating a first random value and furthering the goal under at least one of the series of actions of play between the first and second players; and generating a second random value and furthering the goal under at least one of the series of actions of play between the first and second players; and wherein the game method further includes:

upon occurrence of a negative event, either (i) manually removing one of the predetermined subset of components from the first or second model, or (ii) manually replacing one of the predetermined subset of components from the first or second model with a substitute component, and achieving the game goal when all of the first or second predetermined subset of components are removed or replaced with respect to the first or second model.

12. The game method of claim 11 wherein as the first or second model loses at least one point under the rules of play, at least one of the predetermined subset of components is replaced with a corresponding substitute part, wherein the substitute part depicts damage with respect to the one replaced predetermined subset of components.

13. The game method of claim 11 wherein the first model represents a vehicle or a robot.

14. The method of claim 11, wherein at least some of the predetermined subsets of components either inflict damage on an opponent player's model under the series of actions of play and in furtherance of the goal, or protects a player's model against damage inflicted by the opponent player's model.

15. The method of claim 11, wherein the multiple components are packaged for distribution as a unit, and wherein the unit has one of at least three distribution categories, wherein the three distribution categories are common, uncommon, and rare, which correspond respectively to three levels of distribution rarity.

* * * * *

UNITED STATES PATENT AND TRADEMARK OFFICE

CERTIFICATE OF CORRECTION

Figure 5I:
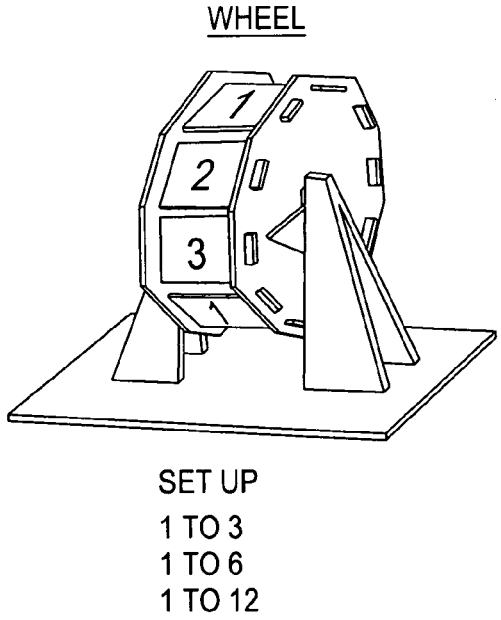
FIG. 5I is an isometric view showing an example of a rotating drum randomizer.

PATENT NO. : 7,201,374 B2
APPLICATION NO. : 10/689971
DATED : April 10, 2007
INVENTOR(S) : Tyler Bielman It is certified that error appears in the above-identified patent and that said Letters Patent is hereby corrected as shown below:

Column 4, line 36, “FIG. 51” should be --FIG. 5I--;

Column 5, line 59, “FIG. 51” should be --FIG. 5I--;

Column 16, line 14, claim 11, “first” should be --second--.

Signed and Sealed this

Twenty-seventh Day of November, 2007

JON W. DUDAS
*Director of the United States Patent and Trademark Office*